US007591150B2

(12) United States Patent
Turner et al.

(10) Patent No.: US 7,591,150 B2
(45) **Date of Patent: *Sep. 22, 2009**

(54) APPARATUS FOR THE LIQUEFACTION OF NATURAL GAS AND METHODS RELATING TO SAME

(75) Inventors: Terry D. Turner, Ammon, ID (US); Bruce M. Wilding, Idaho Falls, ID (US); Michael G. McKellar, Idaho Falls, ID (US)

(73) Assignee: Battelle Energy Alliance, LLC, Idaho Falls, ID (US)

( * ) Notice: Subject to any disclaimer, the term of this patent is extended or adjusted under 35 U.S.C. 154(b) by 407 days.

This patent is subject to a terminal disclaimer.

(21) Appl. No.: 11/383,411

(22) Filed: May 15, 2006

(65) Prior Publication Data

US 2006/0218939 A1 Oct. 5, 2006

Related U.S. Application Data

(60) Continuation-in-part of application No. 11/124,589, filed on May 5, 2005, now Pat. No. 7,219,512, which is a continuation of application No. 10/414,991, filed on Apr. 14, 2003, now Pat. No. 6,962,061, which is a division of application No. 10/086,066, filed on Feb. 27, 2002, now Pat. No. 6,581,409, application No. 11/383,411, and a continuation-in-part of application No. 11/381,904, filed on May 5, 2006, which is a continuation-in-part of application No. 11/124,589, filed on May 5, 2005, now Pat. No. 7,219,512.

(60) Provisional application No. 60/288,985, filed on May 4, 2001.

(51) Int. Cl.

| | |
|---|---|
| ***F25J 1/00*** | (2006.01) |
| ***F25J 5/00*** | (2006.01) |
| ***B01D 9/04*** | (2006.01) |

(52) U.S. Cl. ..... 62/613; 62/532; 62/537

(58) Field of Classification Search ..... 62/613, 62/532, 537

See application file for complete search history.

(56) References Cited

U.S. PATENT DOCUMENTS 1,222,801 A 4/1917 Rosenbaum (Continued)

FOREIGN PATENT DOCUMENTS

DE 1 443 597 1/1970

(Continued)

OTHER PUBLICATIONS

Holmes et al., "Ryan/Holmes Cryogenic Acid Gas/Hydrocarbon Separations Provide Economic Benefits for LNG Production," 7th International Conference on Liquefied Natural Gas; Jakarta, Indonesia; May 1983; Institute of Gas Technology, Session II, vol. 1, pp. 1-15.

(Continued)

*Primary Examiner*—William C Doerrler
(74) *Attorney, Agent, or Firm*—TraskBritt

(57) ABSTRACT

An apparatus and method for producing liquefied natural gas. A liquefaction plant may be coupled to a source of unpurified natural gas, such as a natural gas pipeline at a pressure let-down station. A portion of the gas is drawn off and split into a process stream and a cooling stream. The cooling stream passes through an expander creating work output. A compressor may be driven by the work output and compresses the process stream. The compressed process stream is cooled, such as by the expanded cooling stream. The cooled, compressed process stream is expanded to liquefy the natural gas. A gas-liquid separator separates a vapor from the liquid natural gas. A portion of the liquid gas is used for additional cooling. Gas produced within the system may be recompressed for reintroduction into a receiving line or recirculation within the system for further processing.

40 Claims, 8 Drawing Sheets

U.S. PATENT DOCUMENTS 2,209,534 A 7/1940 Moore
2,494,120 A 1/1950 Ferro, Jr.
2,900,797 A 8/1959 Kurata et al.
2,937,503 A 5/1960 Swearingen et al.
3,132,016 A 5/1964 Kurata
3,168,136 A 2/1965 Ammon
3,182,461 A 5/1965 Johanson
3,193,468 A 7/1965 Sprague
3,213,631 A 10/1965 Kniel
3,236,057 A 2/1966 Hadi Hashemi-Tafreshi
3,254,496 A 6/1966 Roche et al.
3,292,380 A 12/1966 Bucklin
3,312,073 A 4/1967 Jackson et al.
3,315,475 A 4/1967 Harmens
3,323,315 A 6/1967 Carr
3,349,020 A 10/1967 Crownover et al.
3,362,173 A 1/1968 Kniel
3,376,709 A 4/1968 Dickey et al.
3,406,496 A 10/1968 Betteridge et al.
3,407,052 A * 10/1968 Huntress et al. ..... 48/127.3
3,416,324 A 12/1968 Swearingen
3,422,887 A 1/1969 Berkeley
3,448,587 A 6/1969 Goard et al.
3,487,652 A 1/1970 McKay
3,503,220 A 3/1970 Desai
3,548,606 A 12/1970 Kuerston
3,596,473 A 8/1971 Streich
3,608,323 A 9/1971 Salama
3,616,652 A * 11/1971 Engel ..... 62/613
3,628,340 A 12/1971 Meisler et al.
3,677,019 A * 7/1972 Olszewski ..... 62/613
3,690,114 A * 9/1972 Judson et al. ..... 62/613
3,724,225 A 4/1973 Mancini et al.
3,724,226 A 4/1973 Pachalay
3,735,600 A * 5/1973 Dowdell et al. ..... 62/619
3,846,993 A 11/1974 Bates
3,897,226 A 7/1975 Doherty
4,001,116 A 1/1977 Selcukoglu
4,007,601 A 2/1977 Webbon
4,022,597 A 5/1977 Bacon
4,120,911 A 10/1978 Davidson
4,128,410 A 12/1978 Bacon
4,183,369 A 1/1980 Thomas
4,187,689 A 2/1980 Selcukoglu et al.
4,294,274 A 10/1981 LeRoy
4,318,723 A 3/1982 Holmes et al.
4,334,902 A 6/1982 Paradowski
4,359,871 A 11/1982 Strass
4,370,150 A 1/1983 Fenstermaker
4,453,956 A 6/1984 Fabbri et al.
4,479,533 A 10/1984 Persson et al.
4,479,536 A 10/1984 Lameris
4,561,496 A 12/1985 Kehrer
4,609,390 A 9/1986 Wilson
4,611,655 A 9/1986 Molignoni
4,654,522 A 3/1987 Gornick et al.
4,798,242 A 1/1989 Kito et al.
4,846,862 A 7/1989 Cook
4,869,313 A 9/1989 Fredley
4,970,867 A 11/1990 Harron et al.
4,993,485 A 2/1991 Gorman
5,062,270 A 11/1991 Haut et al.
5,174,796 A 12/1992 Davis et al.
5,218,832 A 6/1993 Woolley
5,291,736 A 3/1994 Paradowski
5,327,730 A 7/1994 Myers et al.
5,375,422 A 12/1994 Butts
5,379,832 A 1/1995 Dempsey
5,386,699 A 2/1995 Myers et al.
5,390,499 A 2/1995 Rhoades et al.
5,419,392 A 5/1995 Maruyama
5,450,728 A 9/1995 Vora et al.
5,489,725 A 2/1996 Minkkinen et al.
5,505,048 A 4/1996 Ha et al.
5,505,232 A 4/1996 Barclay
5,511,382 A 4/1996 Denis et al.
5,537,827 A 7/1996 Low et al.
5,551,256 A 9/1996 Schmidt
5,600,969 A 2/1997 Low
5,615,561 A 4/1997 Houshmand et al.
5,615,738 A 4/1997 Cameron et al.
5,655,388 A 8/1997 Bonaquist et al.
5,669,234 A 9/1997 Houser et al.
5,718,126 A 2/1998 Capron et al.
5,755,114 A 5/1998 Foglietta
5,755,280 A 5/1998 Da Costa et al.
5,799,505 A 9/1998 Bonaquist et al.
5,819,555 A 10/1998 Engdahl
5,836,173 A * 11/1998 Lynch et al. ..... 62/613
5,916,260 A 6/1999 Dubar
5,956,971 A 9/1999 Cole et al.
5,983,665 A 11/1999 Howard et al.
6,023,944 A 2/2000 Blundell
6,041,620 A * 3/2000 Olszewski et al. ..... 62/612
6,085,546 A * 7/2000 Johnston ..... 62/613
6,085,547 A 7/2000 Johnston
6,105,390 A 8/2000 Bingham et al.
6,131,395 A 10/2000 Greene et al.
6,131,407 A 10/2000 Wissolik
6,138,473 A 10/2000 Boyer-Vidal
6,138,746 A 10/2000 Livolsi et al.
6,196,021 B1 3/2001 Wissolik
6,200,536 B1 3/2001 Tonkovich et al.
6,212,891 B1 4/2001 Minta et al.
6,220,052 B1 4/2001 Tate, Jr. et al.
6,220,053 B1 * 4/2001 Hass et al. ..... 62/613
6,250,244 B1 6/2001 Dubar et al.
6,354,105 B1 3/2002 Lee et al.
6,367,286 B1 4/2002 Price
6,370,910 B1 4/2002 Grootjans et al.
6,372,019 B1 4/2002 Alferov et al.
6,375,906 B1 4/2002 Edlund et al.
6,378,330 B1 4/2002 Minta et al.
6,382,310 B1 5/2002 Smith
6,389,844 B1 5/2002 Klein Nagel Voort
6,400,896 B1 6/2002 Longardner
6,412,302 B1 7/2002 Foglietta
6,484,533 B1 * 11/2002 Allam et al. ..... 62/643
6,581,409 B2 * 6/2003 Wilding et al. ..... 62/613
6,581,510 B2 6/2003 Koch et al.
6,694,774 B1 2/2004 Rashad et al.
6,767,388 B2 7/2004 Lecomte et al.
6,962,061 B2 * 11/2005 Wilding et al. ..... 62/613
2003/0196452 A1 10/2003 Wilding et al.
2004/0083888 A1 5/2004 Qualls
2004/0105812 A1 6/2004 Tonkovich et al.
2004/0148962 A1 8/2004 Rashad et al.
2005/0220704 A1 10/2005 Morrow et al.

FOREIGN PATENT DOCUMENTS

EP 0 676 599 A 10/1995
EP 1 205 721 A1 5/2002
JP 11200817 A 7/1999
JP 2002071861 A 3/2002
WO WO 88/00936 2/1988
WO WO 98/59206 12/1998
WO 03/062725 A 7/2003

OTHER PUBLICATIONS

Curtin University of Technology, LNG Microcell Progress Update, May 2002, Curtin/Corelab.

International Search Report dated Sep. 17, 2002 (4 pages).

Mott Corporation, "Porous metal solutions," Jun. 2007, 16 pages.

"Porous Metal Design Guidebook," Metal Powder Industries Federation, Princeton, NJ, <<http://www.mpif.org/designcenter/porous.pdf>>, Jun. 2007, 25 pages.

"The Hydrogen Initiative, Panel on Public Affairs," American Physical Society, Mar. 2004, <http://www.aps.org/public_affairs/popa/reports/index.cfm>.

"Hydrogen as an Energy Carrier and its Production by Nuclear Power," IAEA-TECDOC-1085, International Atomic Energy Agency, May 1999.

"A National Vision of America's Transition to a Hydrogen Economy—To 2030 and Beyond," Based on the results of the National Hydrogen Vision Meeting Washington, DC Nov. 15-16, 2001, United States Department of Energy.

"The Hydrogen Economy: Opportunities, Costs, Barriers, and R&D Needs," National Academy of Engineering and Board on Energy and Environmental Systems, 2004, The National Academies Press, <http://books.nap.edu/books/0309091632/html/index.html>.

"Hydrogen Infrastructure Delivery, Reliability R&D Needs," Science Applications International Corporation, Prepared for U.S. Department of Energy, NETL Natural Gas & Infrastructure Reliability Program <www.netl.doe.gov/technologies/oil-gas/publications/td/Final%20White%20Paper%20072604.pdf>.

"Generation of Hydrogen and Transportation and Transmission of Energy Generated on the U.S. Outer Continental Shelf to Onshore," (Minerals Management Service), May 2006.

PCT International Preliminary Report on Patentability and Written Opinion for PCT/US2006/041039 dated Apr. 9, 2009, 7 pages.

PCT International Preliminary Report on Patentability and Written Opinion for PCT/US2007/084677 dated May 28, 2009, 7 pages.

* cited by examiner

2/8

APPARATUS FOR THE LIQUEFACTION OF NATURAL GAS AND METHODS RELATING TO SAME

CROSS-REFERENCE TO RELATED APPLICATIONS

This application is a continuation-in-part of U.S. patent application Ser. No. 11/124,589, filed May 5, 2005, now U.S. Pat. No. 7,219,512, issued May 22, 2007, which is a continuation of U.S. patent application Ser. No. 10/414,991, filed Apr. 14, 2003, now U.S. Pat. No. 6,962,061, issued Nov. 8, 2005, which is a divisional of U.S. patent application Ser. No. 10/086,066, filed Feb. 27, 2002, now U.S. Pat. No. 6,581,409, issued Jun. 24, 2003, and which claims priority of U.S. Provisional Patent Application Ser. No. 60/288,985, filed May 4, 2001. This Application is also a continuation-in-part of U.S. patent application Ser. No. 11/381,904, filed May 5, 2006, entitled APPARATUS FOR THE LIQUEFACTION OF NATURAL GAS AND METHODS RELATING TO SAME, which is also a continuation-in-part of the above-referenced U.S. patent application Ser. No. 11/124,589, filed May 5, 2005, now U.S. Pat. No. 7,219,512, issued May 22, 2007.

This application is also related to U.S. patent application Ser. No. 11/674,984, filed Feb. 14, 2007, U.S. patent application Ser. No. 11/536,477, filed Sep. 28, 2006, U.S. patent application Ser. No. 11/560,682, filed Nov. 16, 2006, U.S. patent application Ser. No. 11/855,071, filed Sep. 13, 2007, and U.S. patent application Ser. No. 09/643,420, filed Aug. 23, 2001, now U.S. Pat. No. 6,425,263, issued Jul. 30, 2002, which is a continuation of U.S. patent application Ser. No. 09/212,490, filed Dec. 16, 1998, now U.S. Pat. No. 6,105,390, issued Aug. 22, 2000, which claims priority to U.S. Provisional Application No. 60/069,988 filed Dec. 16, 1997. The disclosures of the above-referenced patents and applications are each incorporated by reference herein in their entireties.

GOVERNMENT RIGHTS

This invention was made with government support under Contract No. DE-AC07-051D14517 awarded by the United States Department of Energy. The government has certain rights in this invention.

BACKGROUND OF THE INVENTION

1. Field of the Invention

The present invention relates generally to the compression and liquefaction of gases, and more particularly to the liquefaction of a gas, such as natural gas, on a small scale by utilizing a combined refrigerant and expansion process.

2. State of the Art

Natural gas is a known alternative to combustion fuels such as gasoline and diesel. Much effort has gone into the development of natural gas as an alternative combustion fuel in order to combat various drawbacks of gasoline and diesel including production costs and the subsequent emissions created by the use thereof. As is known in the art, natural gas is a cleaner burning fuel than other combustion fuels. Additionally, natural gas is considered to be safer than gasoline or diesel as natural gas will rise in the air and dissipate, rather than settling or accumulating.

To be used as an alternative combustion fuel, natural gas (also termed "feed gas" herein) is conventionally converted into compressed natural gas (CNG) or liquified (or liquid) natural gas (LNG) for purposes of storing and transporting the fuel prior to its use. Conventionally, two of the known, basic processes used for the liquefaction of natural gases are referred to as the "cascade cycle" and the "expansion cycle."

Briefly, the cascade cycle consists of subjecting the feed gas to a series of heat exchanges, each exchange being at successively lower temperatures until the desired liquefaction is accomplished. The levels of refrigeration are obtained with different refrigerants or with the same refrigerant at different evaporating pressures. The cascade cycle is considered to be relatively efficient at producing LNG as operating costs are relatively low. However, the efficiency in operation is often seen to be offset by the relatively high investment costs associated with the expensive heat exchange equipment and the compression equipment associated with the refrigerant system. Additionally, a liquefaction plant incorporating such a system may be impractical where physical space is limited, as the physical components used in cascading systems are relatively large.

In an expansion cycle, gas is conventionally compressed to a selected pressure, cooled, and then allowed to expand through an expansion turbine, thereby producing work as well as reducing the temperature of the feed gas. The low temperature feed gas is then heat exchanged to effect liquefaction of the feed gas. Conventionally, such a cycle has been seen as being impracticable in the liquefaction of natural gas since there is no provision for handling some of the components present in natural gas which freeze at the temperatures encountered in the heat exchangers, for example, water and carbon dioxide. It is noted that the need for expensive pre-clean-up or prepurification is also an issue associated with the cascade cycle.

Additionally, to make the operation of conventional systems cost effective, such systems are conventionally built on a large scale for the processing of large volumes of natural gas. As a result, fewer facilities are built, making it more difficult to provide the raw gas to the liquefaction plant or facility as well as making distribution of the liquefied product an issue. Another major issue with large-scale facilities is the capital and operating expenses associated therewith. For example, a conventional large-scale liquefaction plant, i.e., producing on the order of 70,000 gallons of LNG per day, may cost $2 million to $15 million, or more, in capital expenses. Also, such a plant may require thousands of horsepower to drive the compressors associated with the refrigerant cycles, making operation of the plants expensive.

An additional problem with large facilities is the cost associated with storing large amounts of fuel in anticipation of future use and/or transportation. Not only is there a cost associated with building large storage facilities, but there is also an efficiency issue related therewith as stored LNG will tend to warm and vaporize over time, creating a loss of the LNG fuel product. Further, safety may become an issue when larger amounts of LNG fuel product are stored.

In confronting the foregoing issues, various systems have been devised which attempt to produce LNG or CNG from feed gas on a smaller scale, in an effort to eliminate long-term storage issues and to reduce the capital and operating expenses associated with the liquefaction and/or compression of natural gas. However, such systems and techniques have all suffered from one or more drawbacks.

U.S. Pat. No. 5,505,232 to Barclay, issued Apr. 9, 1996 is directed to a system for producing LNG and/or CNG. The disclosed system is stated to operate on a small scale, producing approximately 1,000 gallons a day of liquefied or compressed fuel product. However, the liquefaction portion of the system itself requires the flow of a "clean" or "purified" gas, meaning that various constituents in the gas such as carbon dioxide, water, or heavy hydrocarbons must be removed before the actual liquefaction process can begin.

Similarly, U.S. Pat. Nos. 6,085,546 and 6,085,547 both issued Jul. 11, 2000 to Johnston, describe methods and systems of producing LNG. The Johnston patents are both directed to small-scale production of LNG, but again, both require "prepurification" of the gas in order to implement the actual liquefaction cycle. The need to provide "clean" or "prepurified" gas to the liquefaction cycle is based on the fact that certain gas components might freeze and plug the system during the liquefaction process because of their relatively higher freezing points as compared to methane, which makes up the larger portion of natural gas.

Since many sources of natural gas, such as residential or industrial service gas, are considered to be relatively "dirty," the requirement of providing "clean" or "prepurified" gas is actually a requirement of implementing expensive and often complex filtration and purification systems prior to the liquefaction process. This requirement simply adds expense and complexity to the construction and operation of such liquefaction plants or facilities.

In view of the shortcomings in the art, it would be advantageous to provide a process, and a system or a plant for carrying out such a process, of efficiently producing liquefied natural gas on a small scale. Additionally, it would be advantageous to provide a system for producing liquefied natural gas from a source of relatively "dirty" or "unpurified" natural gas without the need for "prepurification." Such a system or process may include various clean-up cycles which are integrated with the liquefaction cycle for purposes of efficiency.

It would be additionally advantageous to provide a plant or a system for the liquefaction of natural gas which is relatively inexpensive to build and operate, and which desirably requires little or no operator oversight.

It would be additionally advantageous to provide such a plant or a system which is easily transportable and which may be located and operated at existing sources of natural gas which are within or near populated communities, thus providing easy access for consumers of LNG fuel.

BRIEF SUMMARY OF THE INVENTION

In accordance with one aspect of the invention, a method is provided for producing liquid natural gas. The method includes providing a source of unpurified natural gas and flowing a portion of the natural gas from the source. The portion of natural gas is divided into at least a process stream and a cooling stream. The process stream flows sequentially through a compressor and a first side of at least one heat exchanger. The cooling stream flows sequentially through an expander and a second side of the at least one heat exchanger. A temperature of the process stream is determined after it exits the first side of the first heat exchanger to selectively flow the process stream to one of a plurality of locations. Substantially all of the process stream from the first side of the at least one heat exchanger flows to the second side of the at least one heat exchanger if the sensed temperature is warmer than a specified temperature. At least a portion of the process stream flows from the first side of the at least one heat exchanger to a gas-liquid separator if the sensed temperature is colder than the specified temperature.

The method may further include cooling the process stream to form a slurry within the separator, the slurry comprising at least liquid natural gas and solid carbon dioxide. Cooling the portion of the mass of natural gas may be accomplished by expanding the gas, such as through one or more Joule-Thomson valves. The slurry may be flowed into one or more hydrocyclones by way of one or more pressurized transfer tanks. The transfer tanks may be used alternately or sequentially so as to provide a continuous transfer of slurry to the hydrocyclones. The hydrocyclones substantially separate the solid carbon dioxide and the liquid natural gas. A thickened slush may exit an underflow of the hydrocyclone wherein the thickened slush may include the solid carbon dioxide and a portion of the liquid natural gas. The remaining portion of liquid natural gas is flowed through an overflow of the hydrocyclone.

The method may also include recompressing gas utilized within the plant but which was not stored in liquid form. The recompressed gas may be injected into a pipeline or other facility, or it may be recirculated within the plant to improve the efficiency thereof.

In accordance with another aspect of the invention, a liquefaction apparatus which may also be termed a "plant" is provided. The liquefaction plant includes a first flow path defined and configured for sequential delivery of a first stream of natural gas through a compressor and a first side of at least one heat exchanger. A second flow path is defined and configured for sequential delivery of a second stream of natural gas through an expander and a second side of the at least one heat exchanger. At least two paths, including a cooling path and liquid production path, are formed from the first flow path at a location subsequent the intended flow of the first stream of natural gas through the first side of the at least one heat exchanger. The cooling path is defined and configured to selectively direct a flow of gas to the second side of the at least one heat exchanger. The liquid production path is defined and configured to selectively direct a flow of gas to a gas-liquid separator.

The liquefaction plant may include additional components including a plurality of transfer tanks configured to sequentially or alternately fill with slurry and transfer the slurry to one or more hydrocyclones. The hydrocyclones may be used to separate solids from the liquids. Additionally, filters may be used to further remove solids from the liquids. A sublimation tank may be coupled to the hydrocyclones and configured to receive the solids and sublime them back to a gaseous state.

A recompression compressor may also be used to compress gas processed through the plant but which is not being stored as liquid so as to either reinject the gas back into a pipeline, receiving station or other facility, or to recirculate and reuse the gas within the plant.

BRIEF DESCRIPTION OF THE SEVERAL VIEWS OF THE DRAWINGS

The foregoing and other advantages of the invention will become apparent upon reading the following detailed description and upon reference to the drawings in which.

DETAILED DESCRIPTION OF THE INVENTION

Figure 1:
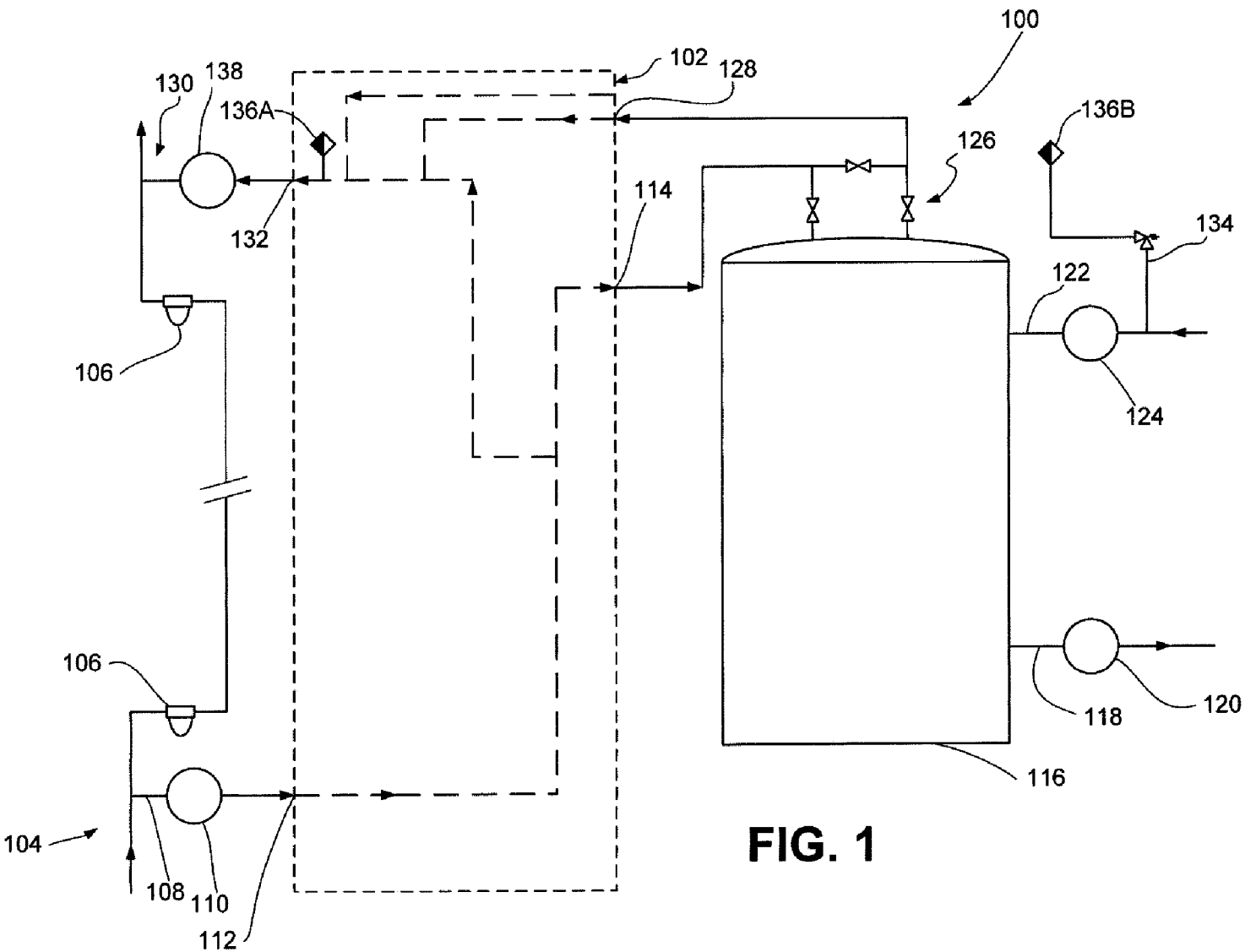
FIG. 1 is a schematic overview of a liquefaction plant according to one embodiment of the present invention.

Referring to FIG. 1, a schematic overview of a portion of a liquefied natural gas (LNG) station 100 is shown according to one embodiment of the present invention. It is noted that, while the present invention is set forth in terms of liquefaction of natural gas, the present invention may be utilized for the liquefaction of other gases as will be appreciated and understood by those of ordinary skill in the art.

The liquefaction station 100 includes a "small-scale" natural gas liquefaction plant 102 which is coupled to a source of natural gas such as a pipeline 104, although other sources, such as a well head, are contemplated as being equally suitable. The term "small-scale" is used to differentiate from a larger-scale plant having the capacity of producing, for example, 70,000 gallons of LNG or more per day. In comparison, the presently disclosed liquefaction plant may have the capacity of producing, for example, approximately 10,000 gallons of LNG a day but may be scaled to produce a different output as needed and is not limited to small-scale operations or plants. Additionally, the liquefaction plant 102 of the present invention is considerably smaller in physical size than conventional large-scale plants and may be readily transported from one site to another.

One or more pressure regulators 106 may be positioned along the pipeline 104 for controlling the pressure of the gas flowing therethrough. Such a configuration is representative of a pressure letdown station wherein the pressure of the natural gas is reduced from the high transmission pressures at an upstream location to a pressure suitable for distribution to one or more customers at a downstream location. Upstream of the pressure regulators 106, for example, the pressure in the pipeline may be approximately 600 to 800 pounds per square inch gauge (psig) while the pressure downstream of the pressure regulators 106 may be reduced to approximately 470 psig, or less. Of course, such pressures are merely examples and may vary depending on the particular pipeline 104 and the needs of the downstream customers. It is noted that the available pressure of the upstream gas in the pipeline 104 (i.e., at plant inlet 112) is not critical as the pressure thereof may be raised, for example by use of an auxiliary booster pump, compressor, or heat exchanger prior to the gas entering the liquefaction process described herein. It is further noted that the regulators 106 may be positioned near the liquefaction plant 102 or at some distance therefrom. As will be appreciated by those of ordinary skill in the art, in some embodiments such regulators 106 may be associated with, for example, low pressure lines crossing with high pressure lines or with a different flow circuits.

Prior to any reduction in pressure along the pipeline 104, a stream of feed gas 108 is split off from the pipeline 104 and fed through a flow meter 110 which measures and records the amount of gas flowing therethrough. The stream of feed gas 108 then enters the small-scale liquefaction plant 102 through a plant inlet 112 for processing, as will be detailed hereinbelow. A portion of the feed gas 108 entering the liquefaction plant 102 becomes LNG and exits the liquefaction plant 102 at a plant outlet 114 for storage in a suitable tank or vessel 116. In one embodiment, the vessel 116 is configured to hold at least 10,000 gallons of LNG at a pressure of approximately 35 psia and at temperatures, for example, as low as approximately −240° F. However, other vessel sizes and configurations may be utilized, for example, depending on specific output and storage requirements of the liquefaction plant 102.

A vessel outlet 118 is coupled to a flow meter 120 in association with dispensing the LNG from the vessel 116, such as to a vehicle which is powered by LNG or into a transport vehicle as may be required. A vessel inlet 122, coupled with a valve/meter set 124 which could include flow and or process measurement devices, enables the venting and/or purging of a vehicle's tank during dispensing of LNG from the vessel 116. Piping 126 associated with the vessel 116 and connected with a second plant inlet 128 provides flexibility in controlling the flow of LNG from the liquefaction plant 102 and also enables the flow to be diverted away from the vessel 116, or for drawing vapor from the vessel 116, should conditions ever make such action desirable.

The liquefaction plant 102 is also coupled to a downstream section 130 of the pipeline 104 at a second plant outlet 132 for discharging the portion of natural gas not liquefied during the process conducted within liquefaction plant 102, along with other constituents which may be removed during production of the LNG. Optionally, adjacent the vessel inlet 122, vent piping 134 may be coupled with piping of liquefaction plant 102 as indicated by interface connections 136A and 136B. Such vent piping 134 will similarly carry gas into the downstream section 130 of the pipeline 104. As noted above, while the second plant outlet 132 is shown as being coupled with the pipeline 104, the second plant outlet 132 could actually be configured for discharging into a different pipeline, a different circuit of the same pipeline, or into some other structure if desired.

Assuming that the second plant outlet 132 is coupled with the pipeline 104, as the various gas components leave the liquefaction plant 102 and enter into the downstream section 130 of the pipeline 104, a valve/meter set 138, which could include flow and/or process measuring devices, may be used to measure the flow of gas therethrough. The valve/meter sets 124 and 138, as well as the flow meters 110 and 120, may be positioned outside of the liquefaction plant 102 and/or inside the liquefaction plant 102, as may be desired. Thus, flow meters 110 and 120, when the outputs thereof are compared, help to determine the net amount of feed gas 140 removed from the pipeline 104 as the upstream flow meter 110 measures the gross amount of gas removed and the downstream flow meter 138 measures the amount of gas placed back into the pipeline 104, the difference being the net amount of feed gas 140 removed from pipeline 104. Similarly, optional flow meter 120 and valve/meter set 124 indicate the net discharge of LNG from the vessel 116.

Figure 2:
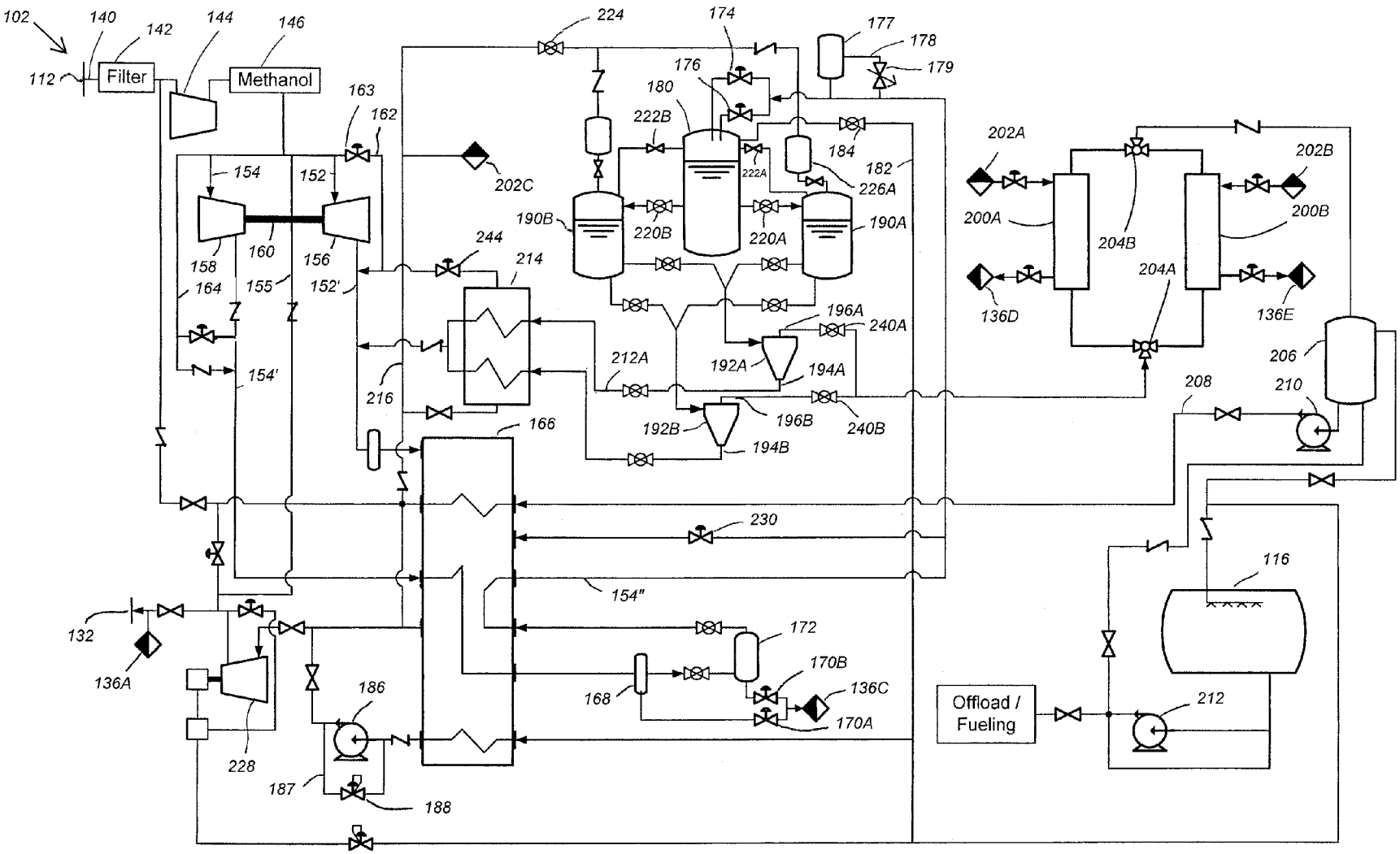
FIG. 2 is a process flow diagram depicting a liquefaction cycle according to one embodiment of the present invention.

Referring now to FIG. 2, a process flow diagram is shown, representative of one embodiment of the liquefaction plant 102 schematically depicted in FIG. 1. As previously indicated with respect to FIG. 1, a high pressure stream of feed gas 140 (i.e., 600 to 800 psia), for example, at a temperature of approximately 60° F. enters the liquefaction plant 102 through the plant inlet 112. While not specifically depicted, prior to processing the feed gas 140, a small portion of feed gas 140 may be split off, passed through a drying filter and utilized as instrument control gas in conjunction with operating and controlling various components in the liquefaction plant 102.

In another embodiment, a separate source of instrument gas, such as, for example, nitrogen, may be provided for controlling various instruments and components within the liquefaction plant 102. As will be appreciated by those of ordinary skill in the art, other instrument controls including, for example, mechanical, electromechanical, or electromagnetic actuation, may likewise be implemented.

Upon entry into the liquefaction plant 102, the feed gas 140 flows through a filter 142 to remove any sizeable objects which might cause damage to, or otherwise obstruct, the flow of gas through the various components of the liquefaction plant 102. The filter 142 may additionally be utilized to remove certain liquid and solid components. For example, the filter 142 may be a coalescing type filter. An example filter is available from Parker Filtration, located in Tewksbury, Mass. and is designed to process approximately 5000 standard cubic feet per minute (SCFM) of natural gas at approximately 60° F. at a pressure of approximately 500 psia. Another example of a filter that may be utilized includes a model AKH-0489-DXJ with filter #200-80-DX available from MDA Filtration, Ltd. of Cambridge, Ontario, Canada.

The filter 142 may be provided with an optional drain which may discharge, for example, into piping near the second plant outlet 132 or it may discharge to some other desired location. In one embodiment, the discharge from the filter 142 may ultimately reenter the downstream section 130 of the pipeline 104 (see FIG. 1). Bypass piping may be routed around the filter 142, allowing the filter 142 to be isolated and serviced, as may be required, without interrupting the flow of gas into the liquefaction plant 102.

After the feed gas 140 flows through the filter 142, it may flow through a compressor 144, if necessary, to raise the pressure of the feed gas 140 to a desired level. For example, if the feed gas 140 entering the inlet 112 from the pipeline 104 (or other source) does not exhibit a desired pressure of, for example, 600 to 800 psig, the compressor 144 may be used to boost the pressure of the feed gas 140 to the desired pressure. If the pressure of the feed gas 140 entering the plant inlet 112 is sufficient, the feed gas 140 may be routed around the compressor 144.

A water clean-up cycle may be incorporated into the liquefaction plant 102. In one example, a water clean-up cycle may include a source of methanol 146, or some other water absorbing product, which is injected into the feed gas 140, such as, for example, by means of a pump, at a location relatively early in the flow of feed gas 140 through the liquefaction plant 102. Such a pump or other device may desirably include variable flow capability to inject methanol into the gas stream such as, for example, by way of at least one of an atomizing or a vaporizing nozzle. In another embodiment, multiple types of nozzles may be utilized such that an appropriate nozzle may be selectively utilized depending on the flow characteristics of the feed gas 140 at a given point in time.

In one embodiment, a suitable pump for injecting the methanol 146 may include variable flow control in the range of 0.4 to 2.5 gallons per minute (GPM) at a design pressure of approximately 1000 psia for a water content of approximately 2 to 7 pounds mass per millions of standard cubic feet (lbm/mmscf). The variable flow control may be accomplished through the use of a variable frequency drive coupled to a motor of the pump. For example, one such pump is available from America LEWA located in Holliston, Mass. as model number EKM7-2-10MM.

When methanol is used, it is mixed with the gas stream to lower the freezing point of any water which may be contained therein. The methanol mixes with the gas stream and binds with the water to prevent the formation of ice in one or more flow paths defined within the liquefaction process.

Subsequent any desired compression of the feed gas 140 and any injection of methanol or other water absorbing materials thereinto, the feed gas 140 is split into two streams, a cooling stream 152 and a process stream 154. In one embodiment, the cooling stream 152 enters a turbo expander 156 at a pressure of approximately 840 psig and at a temperature of approximately 60° F. and is expanded to form an expanded cooling stream 152' exhibiting a lower pressure, for example approximately 50 psig, and a reduced temperature of, for example, approximately −140° F. As will be seen hereinbelow, the expanded cooling stream 152' is a cold mass of fluid that provides cooling during the process of producing liquefied gas.

The turbo expander 156 is a turbine which expands the gas and extracts power from the expansion process. A rotary compressor 158 may be coupled to the turbo expander 156 by mechanical means, such as through a shaft 160, so as to utilize the power generated by the turbo expander 156 to compress the process stream 154. In one embodiment, the reduction of pressure from the transmission line or pipeline 104 to a distribution pressure, effected by the turbo expander 156, provides the majority of the energy used in the liquefaction plant 102 making it extremely economical to operate the liquefaction plant 102.

By compressing the process stream 154, a larger volume of produced liquid will be realized. Additionally, elevated pressures help to keep any $CO_2$ contained within the process stream 154 from plugging the various downstream flow paths.

The proportion of gas in each of the cooling and process lines 152 and 154, respectively, is determined by the power requirements of the compressor 158, as well as the flow and pressure drop across the turbo expander 156. Vane control valves within the turbo expander 156 may be used to control the proportion of gas between the cooling and process lines 152 and 154, as is required according to the above stated parameters. In one embodiment, the feed gas 140 may be proportioned substantially evenly between the cooling and process lines 152 and 154, respectively.

An example of a turbo expander 156 and compressor 158 system includes a frame size ten (10) system available from GE Rotoflow, Inc., located in Gardena, Calif. In one embodiment, the expander 156 and compressor 158 system may be designed to operate at approximately 840 psig at 5,000 pounds mass per hour at about 60° F. The expander/compressor system may also be fitted with gas bearings. Such gas bearings may be supplied with gas through a supply line 155 which draws a portion of the feed gas 140 therethrough. However, the portion of gas directed to any such gas bearing is relatively insubstantial as compared to the mass of gas flowing through the cooling and process lines 152 and 154, respectively. In another embodiment, gas bearings may be supplied by a separate flow of gas such as nitrogen. In yet another embodiment, the expander/compressor system may be fitted with other types of bearings including, for example, magnetic or oil bearings.

Bypass piping 162 routes the cooling stream 152 around the turbo expander 156. Likewise, bypass piping 164 routes the process stream 154 around the compressor 158. The bypass piping 162 and 164 may be used during startup of the liquefaction plant 102 to bring certain components to a steady state condition prior to the processing of LNG within the liquefaction plant 102. For example, the bypass piping 162 and 164 may be used while various components (such as the heat exchanger 166 which will be discussed hereinbelow), are gradually brought to a steady state temperature so as to avoid inducing thermal shock in such components. Additionally, if the pressure of the feed gas 140 is sufficient, the compressor 158 need not be used and the process stream 154 may continue through the bypass piping 164. Indeed, if it is known that the pressure of the feed gas 140 will remain at a sufficiently high pressure, the compressor 158 could conceivably be eliminated. In such a case where the compressor 158 is not being utilized, the work generated by the expander 156 could be utilized to drive a generator or provide power to some other component, if desired. The bypass piping 164 additionally protects the compressor 158 from surging in the event of off-normal flow disruption. For example, if a reduced level of flow through the compressor 158 is sensed or otherwise determined for a given RPM of the compressor 158, valves may be opened to recirculate high pressure gas through the bypass piping 164 to the inlet side of the compressor 158.

Without bypass piping 162 and 164, thermal shock might result from the immediate flow of gas from the turbo expander 156 and compressor 154 into certain downstream components. Depending on the design of specific components being used in the liquefaction plant 102 (e.g., the heat exchanger 166), several hours may be required to bring the system to a thermally steady state condition upon start-up of the liquefaction plant 102.

For example, by routing the process stream 154 around the compressor 158, the temperature of the process stream 154 is not increased prior to its introduction into the heat exchanger 166. However, the cooling stream 152, as it bypasses the expander 156, may pass through an expansion valve, such as a Joule-Thomson (JT) valve 163, allowing the cooling stream 152 to expand thereby reducing its temperature. As will be appreciated by those of ordinary skill in the art, the JT valve 163 utilizes the Joule-Thomson principle that expansion of gas will result in an associated cooling of the gas as well. The cooling stream 152 may then be used to incrementally reduce the temperature of the heat exchanger 166.

In one embodiment, the heat exchanger 166 is a high efficiency heat exchanger made from aluminum. In start-up situations it may be desirable to reduce the temperature of such a heat exchanger 166 by, for example, as much as approximately 1.8° F. per minute until a defined temperature limit is achieved. During start-up of the liquefaction plant 102, the temperature of the heat exchanger 166 may be monitored as it incrementally decreases. The JT valve 163 and other valving or instruments may be controlled in order to effect the rate and pressure of flow in the cooling stream 152 and compressed process stream 154' which ultimately controls the cooling rate of heat exchanger 166 and/or other components of the liquefaction plant 102.

Additionally, during start-up, it may be desirable to have an amount of LNG already present in the tank 116. Some of the LNG may be cycled through the system in order to cool various components if so desired or deemed necessary. Also, as will become apparent upon reading the additional description below, other cooling devices, including additional JT valves, located in various "loops" or flow streams may likewise be controlled during start-up in order to cool down the heat exchanger 166 or other components of the liquefaction plant 102.

When the liquefaction plant 102 or liquefaction system is in a steady state condition, the process stream 154 flows through the compressor 158 raising the pressure of the process stream 154. In one embodiment, the ratio of the outlet to inlet pressures of a rotary compressor may be approximately 1.5 to 2.0, with an average ratio being around 1.7. The compression process is not thermodynamically ideal and, therefore, adds heat to the process stream 154 as it is compressed. To remove heat from the compressed process stream 154', it is flowed through a heat exchanger 166 and is cooled to a very low temperature, for example approximately −200° F. at a pressure, for example, of approximately 1,100 psig. It is noted that, if the heat of compression is too high, the gas may be precooled, for example, by an ambient heat exchanger prior to its entry into the heat exchanger 166. The heat exchanger 166 may include a high efficiency heat exchanger and, in one embodiment, may be formed as a countercurrent flow, plate and fin type heat exchanger. Additionally, the plates and fins may be formed of a highly thermally conductive material such as, for example, aluminum. In one embodiment, a high-efficiency heat exchanger may include a model number 01-46589-1 heat exchanger available from Chart Industries, Inc. of La Crosse, Wis.

The heat exchanger 166 is positioned and configured to efficiently transfer as much heat as possible away from the compressed process stream 154' as it passes therethrough. The liquefaction plant 102 is desirably configured such that temperatures generated within the heat exchanger 166 are never low enough to generate solid $CO_2$ which may be present in the feed gas 140, and which formation of solid $CO_2$ might result in blockage in the flow path of the compressed process stream 154'.

As noted hereinabove, methanol 146 may be mixed with the feed gas 140 to lower the freezing point of any water which may be contained therein. The methanol 146 mixes with the gas stream and binds with the water to prevent the formation of ice in the cooling stream 152 during expansion in the turbo expander 156. Thus, the methanol 146 is present in the process stream 154 and passes therewith through the compressor 158. About midway through the heat exchange process (i.e., between approximately −60° F. and −90° F.) the methanol 146 and water become liquid. The compressed process stream 154' is temporarily diverted from the heat exchanger 166 and passed through a separating tank 168 wherein the methanol/water liquid is separated from the compressed process stream 154'. The liquid is discharged through a valve 170A and the gas flows to a coalescing filter 172 to remove an additional amount of the methanol/water mixture. The methanol/water mixture may be discharged from the coalescing filter 172 through a valve 170B while the dried gas reenters the heat exchanger 166 for further cooling and processing. As is indicated by interface connections 136A and 136C, both valves 170A and 170B discharge the removed methanol/water mixture into piping near the second plant outlet 132 for discharge into the downstream section 130 of the pipeline 104 (see FIG. 1).

In one example, a coalescing filter 172 used for removing the methanol/water mixture may exhibit an efficiency of removing the methane/water mixture to less than approximately 75 ppm/w. One such filter is available from Parker Filtration, located in Tewksbury, Mass.

The liquefaction process shown in FIG. 2 thus provides for efficient production of natural gas by integrating the removal of water during the process without expensive equipment and preprocessing required prior to the liquefaction cycle, and particularly prior to the expansion of the gas through the turbo expander 156.

After exiting the heat exchanger 166, the cooled, compressed process stream 154" (referred to hereinafter as the product stream 154" for purposes of convenience) flows through two expansion valves, such as JT valves 174 and 176, respectively, and into a liquid/vapor separator 180. The two JT valves 174 and 176 are arranged in a parallel flow configuration and work in concert with one another to control the flow of the product stream 154" into the separator 180. In one embodiment, the two JT valves 174 and 176 are of different sizes. In other words, the two JT valves may exhibit different flow coefficients ($C_v$). For example, in one embodiment, one valve 174 may be sized and configured to accommodate approximately 80% of the flow entering into the separator 180 from the product stream 154" while the other JT valve 176 may be sized and configured to accommodate the remaining approximately 20% of the flow.

Of the two JT valves 174 and 176, the larger valve is held at a constant position while the valve carrying the remaining flow is used for the fine control required to maintain a desired flow rate. As the gas expands through the valves, a Joule- Thomson (JT) effect reduces the temperature and pressure from, for example, approximately 1100 psig at approximately −185° F. to approximately 35 psig and approximately −230° F. (which is the saturation temperature and pressure for the liquid). This pressure drop also precipitates solid $CO_2$. The three phase (gas, liquid, and solid $CO_2$) mixture exiting the JT valves 174 and 176 is collected in the separator tank 180.

While a single valve may be used instead of the two JT valves 174 and 176, the use of two (or more) JT valves 174 and 176 provides a more controlled flow and reduces shock or fluctuation in the stream. Additionally, the use of multiple valves may be beneficial during start-up of the liquefaction plant 102 because the gas is less dense in such circumstances. An accumulator 177 may coupled with the product stream 154" at a location downstream from the JT valves 174 and 176 to further dampen flow pulses that may be introduced into the stream 154" by the JT valves 174 and 176. A pressure sense line 178 may extend between the accumulator 177 and the product stream 154" and may be buffered by a restrictive valve 179. Additionally, the accumulator 177 may be directly coupled to the product stream 154".

When the product stream 154" passes through the two expansion JT valves 174 and 176, the product stream 154" follows a constant enthalpy pressure drop that changes from a high pressure, single phase mixture at a high pressure and low temperature (e.g., approximately 1,100 psig and approximately −200° F.) to three phases (solid, liquid and gas) with approximately 10% to 28% mass flow being vapor, at a reduced pressure of, for example, 35 psig. The solid component includes solid $CO_2$. The vapor component from the separator 180 is collected and removed therefrom through vapor piping 182 and is routed back to the heat exchanger 166 to provide additional cooling by way of a compressor 186. While shown to be located on the warm side of the heat exchanger 166, it could be positioned on the cold side of the heat exchanger 166, although such positioning might require the compressor 186 to be configured as a cryogenic compressor. In one embodiment, the compressor 186 may be powered by an internal combustion engine fueled by a portion of the natural gas flowing through the liquefaction plant 102. In another embodiment, the compressor 186 may be powered by an electric motor or other means as will be appreciated by those of ordinary skill in the art. It is further noted that an ejector or an eductor might be utilized in place of the compressor 186 in another embodiment.

To maintain the separator 180 at a desired pressure, for example at approximately 35 psig, the compressor 186 may be used to recompress the excess gas from the separator 180 to pressures suitable, for example, for introduction of the gas into the heat exchanger 166. For example, the compressor 186 may be used to increase the pressure of the gas from approximately 35 psig to approximately 50 psig. The compressor 186 may also be coupled to a vent line associated with the storage tank 116 to likewise help maintain the pressure within storage tank 116 at substantially the same pressure as that of the separator 180.

A make-up loop 187 having a regulator 188 may be routed around the compressor 186 to prevent flow surges as may be the case when gas from the separator 180 and or storage tank 116 is relatively low. The pressure of such a regulator may be set at a level that is just under the desired saturation pressure for the separator 180. In one embodiment, a floating ball check valve may also be installed in the suction line of the compressor 186 to prevent a sudden surge of liquid. If the compressor 186 is located on the cold side of the heat exchanger 166, the floating ball check valve may also be used to prevent any accumulated liquid from entering the suction side of the compressor 186. It is noted that if the compressor 186 is located on the warm side of the heat exchanger 166, no liquid will be present at the suction side of the compressor 186 under normal operating conditions.

A back-pressure regulator may be located in the vapor piping 182 to also help control the pressure within the separator 180. In one example, the back pressure regulator 184 may be configured with a set-point of approximately 35 psig so as to create a saturation pressure of the liquid that is below a desired transfer pressure (i.e., the pressure used to transfer liquid from the separator 180 to other components within the liquefaction plant 102).

In one embodiment, the storage tank 116 may be maintained at substantially the same pressure as that of the separator 180. By maintaining the liquid saturation pressure below associated transfer pressures, the liquid is prevented from boiling when the liquid experiences a pressure drop such as will occur when the liquid flows through piping, valves and other equipment as it is transferred from the separator 180. The pressure difference between the separator 180 (e.g., approximately 35 psig) and a transfer pressure may be specified such that it is sufficient to ensure that any and all line pressure drops encountered en route to the storage tank 116 are accounted for. The liquid will then arrive at the storage tank 116 at saturation pressure, minimizing loss and flow complications that might otherwise occur due to boiling of the liquid during the transfer thereof.

As noted above, solid $CO_2$ mostly forms as small crystals in the liquid as it exits the JT valves 174 and 176. With the appropriate resident time in the liquid, the $CO_2$ becomes a sub-cooled solid particle. In the sub-cooled state the particles are less likely to clump together. Keeping the particles suspended in the liquid provides more effective and efficient transfer and separation of the solids from the liquid component. If allowed to settle, the particles have a tendency to clump or stick together. To aid in keeping the $CO_2$ particles suspended in the liquid, gas bubbles may be introduced into the bottom of the separator 180. Introduction of the gas bubbles helps to agitate the $CO_2$ solids within the liquid and keep the particles continually moving within the liquid. While not specifically shown in FIG. 2, gas may be drawn from, for example, a location subsequent the coalescing filter 172, to provide the bubbling and agitation of the solids within the separator 180.

As the separator 180 is filled, the level may be monitored by appropriate sensors. The level of the liquid/solid within the separator 180 may be desirably monitored and controlled in order to provide desired resident times for the $CO_2$ and thereby ensure that the $CO_2$ particles are subcooled.

When a specified maximum level of liquid/solid slurry is reached within the separator 180, the liquid/solid slurry will be transferred to at least one of a plurality of transfer tanks 190A and 190B. In one embodiment, the transfer tanks 190A and 190B are used alternately. The transfer tanks 190A and 190B are utilized to transfer the slurry from the separator 180 to one of a plurality of hydrocyclones 192A and 192B. While it is possible to transfer the slurry from the separator 180 to the hydrocyclones 192A and 192B without the use of the transfer tanks 190A and 190B, it is believed that, in the currently described embodiment, the use of transfer tanks 190A and 190B provides improved control over the transfer of the slurry (including transfer of the slurry to the hydrocyclones 192A and 192B and subsequent transfer of the liquid from the hydrocyclones 192A and 192B to downstream components such as the storage tank 116), and ensures that adequate transfer pressures are maintained during such transfer. If pressures are not properly maintained during transfer of the slurry, the liquid may boil due to pressure losses associated with piping and other components. Additionally, failure to maintain proper pressures during transfer of the slurry may result in inadequate solid-liquid separation. The use of separate, alternating tanks 190A and 190B to effect the transfer of the slurry from the separator 180, is one means that may be used to maintain the pressure integrity of the liquefaction plant 102.

When the separator 180 has reached its specified maximum level, two valves will open allowing the fluid to move into one of the transfer tanks (e.g., transfer tank 190A for purposes of the present discussion). The first valve 220A allows the transfer of liquid/$CO_2$ slurry, while the second valve 222A vents the transfer tank 190A back to the separator 180 enabling the captured gases in the transfer tank 190A to escape as it is being filled with the slurry. Depending, for example, on the length of the piping run between the separator 180 and the transfer tank 190A, bubbler locations may be added to the bottom of the pipe to prevent the $CO_2$ from settling during the transfer of the slurry (similar to that which has been previously described with respect to the separator 180).

When the level in the separator 180 tank is reduced to a specified level, the first and second valves 220A and 222A, respectively, to the transfer tank 190A close. The liquid $CO_2$ transfer switches between the two transfer tanks associated with the SGL tank. Once the valves connecting the SQL and transfer tank are closed, the liquid/$CO_2$ mixture is ready to be transferred to the hydrocyclone separator. The pressure sensitive hydrocyclone separator separates the $CO_2$ from the liquid by cyclonic action. The transfer tank is pressurized to the desired pressure and the transfer valve is opened. The transfer pressure is approximately 20 psi higher than the saturation pressure of the liquid. This pressure head provides the motive force for the liquid/$CO_2$ mixture, prevents the liquid from boiling, as pressure drops are realized, and prevents the formation of additional $CO_2$ that could occur if the pressure were to drop below saturation pressure.

By alternating the filling of the two (or more) transfer tanks 190A and 190B, a constant flow of slurry to a selected hydrocyclone (e.g., hydrocyclone 192A) may be easily maintained. The alternating use of transfer tanks 190A and 190B also improves the efficiency and effectiveness of the separation process performed by the hydrocyclones 192A and 192B. It is noted that, if the rate at which liquid is produced (i.e., within the separator 180) falls behind with respect to a desired separation rate of a hydrocyclone 192A, the flow to the hydrocyclone 192A may be suspended while the separator 180 and transfer tanks 190A and 190B fill to a desired level. The transfer tanks 190A and 190B and hydrocyclones 192A and 192B may be oversized to prevent the possibility of producing liquid in the separator 180 faster than the transfer/separation capabilities of the hydrocyclones 192A and 192B.

The transfer tank (considering tank 192A as an example) is pressurized by use of a pressure regulator 224, which is set at a desired transfer pressure. If the feed line to the transfer tank 192A is sufficient and the pressure regulator 224 is large enough, a pressure regulator 224 can be mounted directly on the transfer tank 192A. This would require one regulator for each tank. However, in another embodiment, both transfer tanks 192A and 192B could be maintained with a smaller feed line and a single pressure regulator 224, as shown in FIG. 2. Use of a single pressure regulator may require the use of a storage or accumulator tanks (e.g., accumulator tanks 226A) to ensure that the proper volume of gas is used so as to maintain the pressure constant during the complete transfer process. It is noted that the gas used to transfer the liquid will be warmer than the liquid/solid slurry being transferred. As such, any heat transfer effects are accounted for in configuring and sizing the pressure regulator(s) 224A and accumulator tank(s) 226A.

As previously noted, the liquid/solid slurry is transferred to and processed by one of the hydrocyclones 192A and 192B. The hydrocyclones 192A and 192B act as separators to remove the solid $CO_2$ from the slurry allowing the LNG or other liquid product to be collected and stored. The hydrocyclones 192A and 192B may be configured to be substantially identical to one another. As such, only a single hydrocyclone 192A is referenced with respect to the particular details thereof. In one embodiment, the hydrocyclone 192A may be designed, for example, to operate at a pressure of approximately 125 psia at a temperature of approximately −238° F. The hydrocyclone 192A uses a pressure drop to create a centrifugal force which separates the solids from the liquid. A thickened slush, formed of a portion of the liquid natural gas with the solid $CO_2$, exits the hydrocyclone 192A through an underflow 194A. The remainder of the liquid natural gas is passed through an overflow 196A for additional filtering. A slight pressure differential, for example, between approximately 0.5 psid and 1.5 psid, exists between the underflow 194A and the overflow 196A of the hydrocyclone 192A. The pressure in the hydrocyclone 192A is provided and maintained by the transfer tank (192A or 192B). A control valve 240A may be positioned at the overflow 196A of the hydrocyclone 192A to assist in controlling the pressure differential developed within the hydrocyclone 192A. The underflow pressure may be controlled by the mid-system pressure as may be maintained by the suction side of a recompression compressor 228 (if one is being used) or by the distribution line pressure at the plant outlet 132.

A suitable hydrocyclone is available, for example, from Krebs Engineering of Tucson, Ariz. In one example, the hydrocyclone 192A may be configured to operate at design pressures of up to approximately 125 psi within a temperature range of approximately 100° F. to −300° F. Additionally, the hydrocyclone 192A may desirably include an interior surface which is micro-polished to an 8 to 12 micro inch finish or better.

It is noted, that the hydrocyclones 192A and 192B are selectively coupled with each of the transfer tanks 190A and 190B through appropriate valving and piping, such that each of the transfer tanks 190A and 190B may selectively flow slurry to either of the hydrocyclones 192A and 192B. The use of two hydrocyclones 192A and 192B provides redundancy in the system so that if one hydrocyclone becomes plugged (or partially plugged), the other hydrocyclone may be used while appropriate maintenance is performed on the first. If desired, warm gas may be routed from another location in the liquefaction plant 102 to assist in unplugging a hydrocyclone such as by melting or sublimation of solid $CO_2$ that may be the source of any such plugging. The selection and control of the transfer tanks 190A and 190B and hydrocyclones 192A and 192B will be further discussed hereinbelow with respect to the control and operation of the liquefaction plant 102.

The liquid natural gas flows through the overflow 196A of the hydrocyclone 192A and may flow through one of a plurality of filters 200A and 200B placed in a parallel flow configuration. The filters 200A and 200B capture any remaining solid $CO_2$ which may not have been separated out in the hydrocyclone 192A. The filters 200A and 200B may be configured such as substantially described in the priority patent applications and patents that have been incorporated by reference. Generally, in one embodiment, such filters 200A and 200B may include a first filter screen of coarse stainless steel mesh, a second conical shaped filter screen of stainless steel mesh less coarse than the first filter screen, and a third filter screen formed of fine stainless steel mesh. In another embodiment, all three filter screens may be formed of the same grade of mesh.

The filters 200A and 200B may, from time to time, become clogged or plugged with solid $CO_2$ captured therein. Thus, as one filter, i.e., filter 200A, is being used to capture $CO_2$ (or other solids) from the liquid stream, the other filter, i.e., filter 200B, may be purged of $CO_2$ by passing a relatively high temperature natural gas therethrough in a counter flowing fashion. For example, gas may be drawn from a relatively warmer gas stream, as indicated at interface points 202B (or 202A for filter 200A) and 202C to flow through and clean the filter 200B.

During cleaning of the filter 200B, the cleaning gas may be discharged to a downstream location within the liquefaction plant 102 adjacent the second plant outlet 132 as indicated by interface connections 136E (136D for filter 200A) and 136A. Appropriate valving and piping including, for example, three-way valves 204A and 204B, which may be used to enable the filters 200A and 200B to be switched and isolated from one another as may be required. Other methods of removing $CO_2$ solids (or other solids) that have accumulated in the filters 200A and 200B are readily known by those of ordinary skill in the art.

In another embodiment, the filters 200A and 200B may be configured to include a floating bed that traps solid $CO_2$ while permitting fluid to pass therethrough. As the floating bed becomes filled with $CO_2$, the trapped $CO_2$ settles to the bottom. When the filter (e.g., filter 200A) is filled with $CO_2$, an elevated pressure differential develops indicating that the filter 200A needs to be cleaned and flow can be switched to the redundant filter (e.g., filter 200B). The first filter 200A may then be cleaned in a manner similar to that which has been described hereinabove.

The filtered liquid passes from the filter 200A (or filter 200B) to a diversion tank 206. Liquid in the diversion tank 206 may be selectively passed to the storage tank 116, utilized for additional cooling within the liquefaction plant 102, or both. When used for additional cooling, the liquid in the diversion tank 206 may be routed back to the heat exchanger 166, such as through stream 208 and by use of an appropriate pump 210 (referred to herein as a diversion pump). The diversion pump 210 may also be used to elevate the pressure of the liquid such that it may be subsequently recirculated through the liquefaction plant 102 or reintroduced into the pipeline 104. For example, a positive displacement pump may be used to pump liquid out of the diversion tank 208 to the heat exchanger 166 while increasing the pressure of the liquid to, for example, approximately 495 psig if the liquid is going to be passed back to the pipeline 104 (or some other receiving line) or, for example, to approximately 800 psig if the liquid is to be recirculated back through the liquefaction plant 102. By pressurizing to liquid to a distribution or recirculation pressure, the load on the recompression recompressor 228 is reduced, it being more efficient to compress a liquid than it is to compress a gas.

The diversion tank 206 may also be supplied with liquid by way of a make-up pump 212 coupled with an outlet of the storage tank 116. In the event of off normal or startup conditions, where the liquefaction plant 102 is not supplying adequate liquid to keep the diversion tank 206 full, the make-up pump 212 may be used to supply the needed liquid. When the liquid level drops to a predetermined level within the diversion tank 206, the make-up pump 212 will start and fill the diversion tank 206 back to a desired level. Thus, a supply of liquid may be maintained in the diversion tank 206 which may be pumped into the heat exchanger 166 to assist in preparing the liquefaction plant 102 for the liquid production process. In other words, the cryogenic liquid in the diversion tank 206 may be used provide cooling during in the final stages of the heat exchanger 166 in order to reduce the temperature of what becomes the compressed product stream 154" to temperatures required for liquid production.

In one embodiment, the flow of liquid from the diversion tank 206 to the heat exchanger 166 may be controlled based on the temperature of the product stream 154". Thus, for example, as the temperature of the product stream 154" becomes warmer, the diversion pump 210 may provide additional flow of liquid from the diversion tank 206 to the heat exchanger 166. Additionally, as the temperature of the product stream 154" decreases, the diversion pump 210 may be controlled to reduce the amount of liquid being provided to the heat exchanger 166. The diversion pump 210 may be configured as a variable flow pump and controlled, for example, by a proportional, integral, derivative (PID) controller.

Referring back to the hydrocyclones 192A and 192B, the thickened slush formed in the hydrocyclone (e.g., hydrocyclone 192A) exits the underflow 194A and passes through piping 212A to a sublimation tank 214. The sublimation tank 214 may include, for example, a heat exchanger configured to convert the solid $CO_2$ to a gaseous state.

In one particular embodiment, the sublimation tank 214 may include a tube-in-shell heat exchanger such as that which is disclosed in the priority applications and patents previously incorporated by reference. The slush may enter such a heat exchanger on the tube side thereof. In one embodiment, the slush entering the sublimation tank 214 will include approximately 10% solid $CO_2$ by mass in a liquid carrier. Warm gas, for example, gas at a temperature of approximately 100° F., may flow through the sublimation tank 214 by way of a flow path 216 from the heat exchanger 166, or from some other location, to heat the slush and effect sublimation of the solid $CO_2$.

It has been determined that, in natural gas mixtures found in conventional U.S. pipelines, $CO_2$ becomes a solid at approximately −160° F. at approximately 35 psig. However, once the $CO_2$ has frozen, it no longer follows the phase change path it would when found in the natural gas mixture. Instead, the solid $CO_2$ acts as pure $CO_2$ which sublimes at approximately −80° F. and at approximately 35 psig.

As the slush enters the sublimation tank 214, the liquid carrier violently flashes to a gas which, in addition to transferring heat to the solid $CO_2$, provides a positive motive flow for the solid $CO_2$. Due to the turbulent nature of the flow, the $CO_2$ constantly interacts with tube walls as it progresses through the tubes. Additionally, the tube walls become progressively warmer along the flow path of the $CO_2$. Once all of the liquid has flashed to a gas and warmed to approximately −80° F., the $CO_2$ will start to sublime, aided by the relatively warm tube walls and the warmed gases. It is noted that the sublimation tank 214 may be configured such that the warm gas from stream 216 will warm all areas of the shell (when configured as a tube-in-shell heat exchanger) to a temperature above the sublimation temperature of the $CO_2$. In this manner, the sublimation tank 214 becomes "self-thawing" in the case of any potential plugs caused by the solid $CO_2$ passing through the tube side thereof.

The gas leaving the sublimation tank 214 (including both the warming gas and the sublimed $CO_2$) may be routed back to the expanded cooling stream 152' to assist in cooling the compressed process stream 154' in heat exchanger 166.

As previously noted hereinabove, the liquefaction plant 102 may include a recompression compressor 228. The recompression compressor 228 may be used to recompress gas to a desired pressure prior to reintroduction of the gas into the pipeline 104 (or other receiving station or system) or prior to the recirculation of gases into the liquefaction plant 102 for reprocessing thereof. Gas from the separator 180 and from the storage tank 116 may be used, for example, as fuel for a combustion engine that drives the recompression compressor 228.

It is noted that, while not specifically shown, a number of valves may be placed throughout the liquefaction plant 102 for various purposes such as facilitating physical assembly and start-up of the liquefaction plant 102, maintenance activities, or for collecting of material samples at desired locations throughout the liquefaction plant 102 as will be appreciated by those of ordinary skill in the art.

It is further noted that the liquefaction plant 102 may be configured as a relatively compact structure such as described in the applications and patents previously incorporated by reference. Generally, the liquefaction plant 102 may be constructed on one or more skids for simple transportation and erection of the liquefaction plant 102.

The liquefaction plant 102 may further include controls such that minimal operator input is required for the operation of the liquefaction plant 102. Indeed, it may be desirable that the liquefaction plant 102 be able to function without an on-site operator. Thus, with proper programming and control design, the liquefaction plant 102 may be accessed through remote telemetry for monitoring and/or adjusting the operations of the liquefaction plant 102. Similarly, various alarms may be built into such controls so as to alert a remote operator or to shut down the plant in an upset condition. One suitable controller, for example, may be a DL405 series programmable logic controller (PLC) commercially available from Automation Direct of Cumming, Ga.

Reviewing now the operation of the liquefaction plant 102 and considering various control aspects thereof, when the liquefaction plant 102 is started, the JT valves 174 and 176 are closed such that the product stream 154" is diverted back into the heat exchanger 166 after passing through a JT valve 230. This produces a cooling stream that may be used to cool the heat exchanger 166 until the temperature of the product stream 154" approaches approximately −90° F. at a pressure of approximately 800 psig. When starting, the expander 156/compressor 158 will be manually accelerated at a rate that corresponds with approximately 2° F. per minute temperature reduction in the heat exchanger 166. This acceleration may stop when the pressure of the compressed process stream 154' builds to approximately 800 psig. If the pressure of the pipeline 104 or other source is running at a pressure of approximately 800 psig, use of the compressor 158 may not be necessary. However, the compressor 158 may be started to provide a desired boost in pressure to the process stream 154.

Prior to closing the JT valve 230 in the cooling stream and opening valves 174 and 176, the diversion tank 206 may be filled with liquid from the storage tank 116. The flow may simply fill the diversion tank 206 or it may recirculate back into the storage tank 116. When the temperature of the product stream 154" reaches a desired temperature, the flow of product stream 154" is routed to the separator 180. At this time the diversion pump 210 will start pumping liquid from the diversion tank 206 to the heat exchanger 166 to aid in the final and rapid cooling of the compressed process stream 154'.

Switching the flow of the product stream 154" into the separator 180 will prevent $CO_2$ from building up in the heat exchanger 166. It is noted that $CO_2$ formation begins when the pressure drops from approximately 800 psig at approximately −160° F. to a pressure of approximately 35 psig at a temperature of approximately −220° F. The initially warm tank of the separator 180 will flash the small amount of liquid and $CO_2$ to a gas, as the temperature of the product stream 154" decreases. Decreased temperatures in the product stream 154" result in the production of additional liquid. The liquid quality will also improve as the temperature drops and the $CO_2$ will be suspended in the liquid as the tank of the separator 180 cools to a point at which the liquid remains.

If the separator 180 should fill before the temperature of the product stream 154" is within the desired range, the separator 180 may be flushed. Flushing the cold liquid into the warm transfer tanks 190A and 190B will boil off most of the liquid and any remaining liquid may be used to continue cooling off various components of the liquefaction plant 102. As the temperature of the product stream 154" reaches a desired range of, for example, approximately −180° F. to approximately −200° F., the expander 156 will be slowly accelerated to a desired operational speed.

During operation of the liquefaction plant 102, the relationship between the "back-end flow loop" and the "cooling loop" may be used as the basis for the liquid production and control of the liquefaction plant 102. The back-end flow loop generally refers to the flow of fluid through the liquid handling components of the plant and particularly the flow through the valve or valves (e.g., JT valves 174 and 176) leading into the gas-liquid separator 180. The cooling loop refers generally to flow of fluid that provides cooling via the heat exchanger 166 during normal operating conditions and particularly includes the flow of liquid from the diversion tank 206.

During the start-up and early operation of the liquefaction plant 102, all the high pressure flow may be managed by the back-end flow loop. A set-point for control of this loop may be automatically set by equations defining the state of the expander 156 and flow conditions coming into the liquefaction plant 102. The initial purpose is to manage the flow requirements of the compressor 158 and provide cooling to the process. With all the high pressure mass flow initially going into the cooling of the heat exchanger 166 the cooling is maximized.

During the initial cooling phase of the heat exchanger 166 and process fluid, the warm temperature of the product stream 154" keeps the cooling loop turned off. As the temperature cools and starts to approach a specified set-point (for example, approximately −175° F.) the diversion pump 210 will start to run and accelerate the final cooling as the temperature of the product stream 154" approaches the set-point. As the temperature of the product stream 154" cools to a temperature below the set-point, the diversion pump 210 will reduce its output to decrease the refrigeration of the heat exchanger 166. The temperature of the product stream 154" will continue to be monitored and the output of the diversion pump 210 will be adjusted accordingly until the desired temperature conditions (set-points) are met. This balanced condition will result in a steady state production of liquid flowing into the separator 180 with a steady state refrigeration flow into the heat exchanger 166.

Additionally, in operating the liquefaction plant 102, various parameters may be monitored and various adjustments implemented in order to maintain operation of the expander 156/compressor 158 within a desired range and in order to produce LNG at a desired rate with specified temperature and pressure characteristics. Control of the liquefaction plant 102 may be fully or partially automated, such as, for example, by using an appropriate computer, a programmable logic circuit (PLC), using closed-loop and open-loop schemes, using proportional, integral, derivative (PID) control, or other appropriate control and programming tools, as will be appreciated by those of ordinary skill in the art. Additionally, if desired, the liquefaction plant 102 may be operated manually. The following discussion provides further examples of logic that may be used in controlling the liquefaction plant 102.

In order to efficiently run the expander 156/compressor 158 within desired speed and flow parameters, certain flow criteria should be met. If control is being automated, the control system may be configured to set and maintain these flow requirements automatically, by equation. The equation may also automatically calculate a flow set-point that meets the flow requirements of the expander 156/compressor 158. The equation may start calculating flow values as soon as the expander 156/compressor 158 is started.

In addition to that described above regarding the relationship of the back-end flow loop and the cooling loop, in accordance with one control scheme, the back-end flow loop may be used as a primary control mechanism in operating the liquefaction plant 102. A desired flow set-point is initially determined for the back-end flow. This flow set-point represents a flow rate that is sufficient to ensure that adequate flow is provided to the expander 156/compressor 158 and is sufficient to activate flow sensors that may be positioned throughout the plant at desired locations.

It is noted that, depending on the type of flow meters or flow sensors being used, the calculated flow set-point may be insufficient during slow speed operation of the expander 156/compressor 158 to maintain detection of the flow(s) throughout the liquefaction plant 102. Thus, it may be desirable to utilize a manual set-point (i.e., one that is not determined by the automatic calculation) until the speed of the expander 156 is sufficiently high such that any automatic flow calculation set-point matches or exceeds the manual set-point. Once the manual and calculated set-points match, the system can be switched from manual to automatic set-point generation. From this point on the automatic set-point may be used to maintain the appropriate flows required by the expander 156/compressor 158 for proper operation.

The actual back-end flow (ABEF) is derived by indirectly determining the flow through the compressor 158 (i.e., the process stream 154). With continued reference to FIG. 2, the flow is determined as follows:

$$ABEF = F112 - (F152 + F155) \quad \text{EQ 1A}$$

Where ABEF is the calculated or actual back-end flow (lbm/hr); F112 is the flow coming into the liquefaction plant 102 through the plant inlet 112 (lbm/hr); F152 is the flow of cooling stream 152 through the expander 156 (lbm/hr); and F155 is the flow of supply line 155 to the gas bearings. The flow of supply line 155 to the gas bearings may be a fixed value and considered a constant. If cooling flow from the diversion pump 210 is being recycled into the system by way of the recompression compressor, the back-end flow becomes $$ABEF = F112 + F210 - (F152 + F155) \quad \text{EQ 1B}$$

Where F210 is the flow of liquid from the diversion pump 210.

The back-end flow value or set-point BE is the flow feedback value used to determine if the system is responding correctly and causing the flow to progress towards the set-point. The BE value is basically the same value as that which is measured by a flow meter as it flows through the compressor 158 (although independently derived) and is only different due to minor flows within the system. However, having two independent flow values representative of the flow through the compressor 158 may be important when considering surge flows as discussed hereinbelow.

The automatic back-end flow set-point BE is determined by the following equation:

EQ 2:

$$BE = 15000\left(\frac{RPM}{85000}\right)\left(\frac{P154}{840}\right)BESF$$

Where BE is the automatic back-end flow set-point (lbm/hr); 15000 is a constant and is the maximum design flow through the compressor 158 at 85000 RPM, and 840 psia, (lbm/hr); RPM is the current revolutions per minute of the compressor 158; 85000 is a constant and is the design speed (RPM) of compressor 158; P154 is the current pressure (psia) at the inlet of the compressor 158; 840 is a constant and is the design pressure (psia) for the inlet of the compressor 158; and BESF is the back-end flow safety factor (a dimensionless multiplier).

Figure 3A:
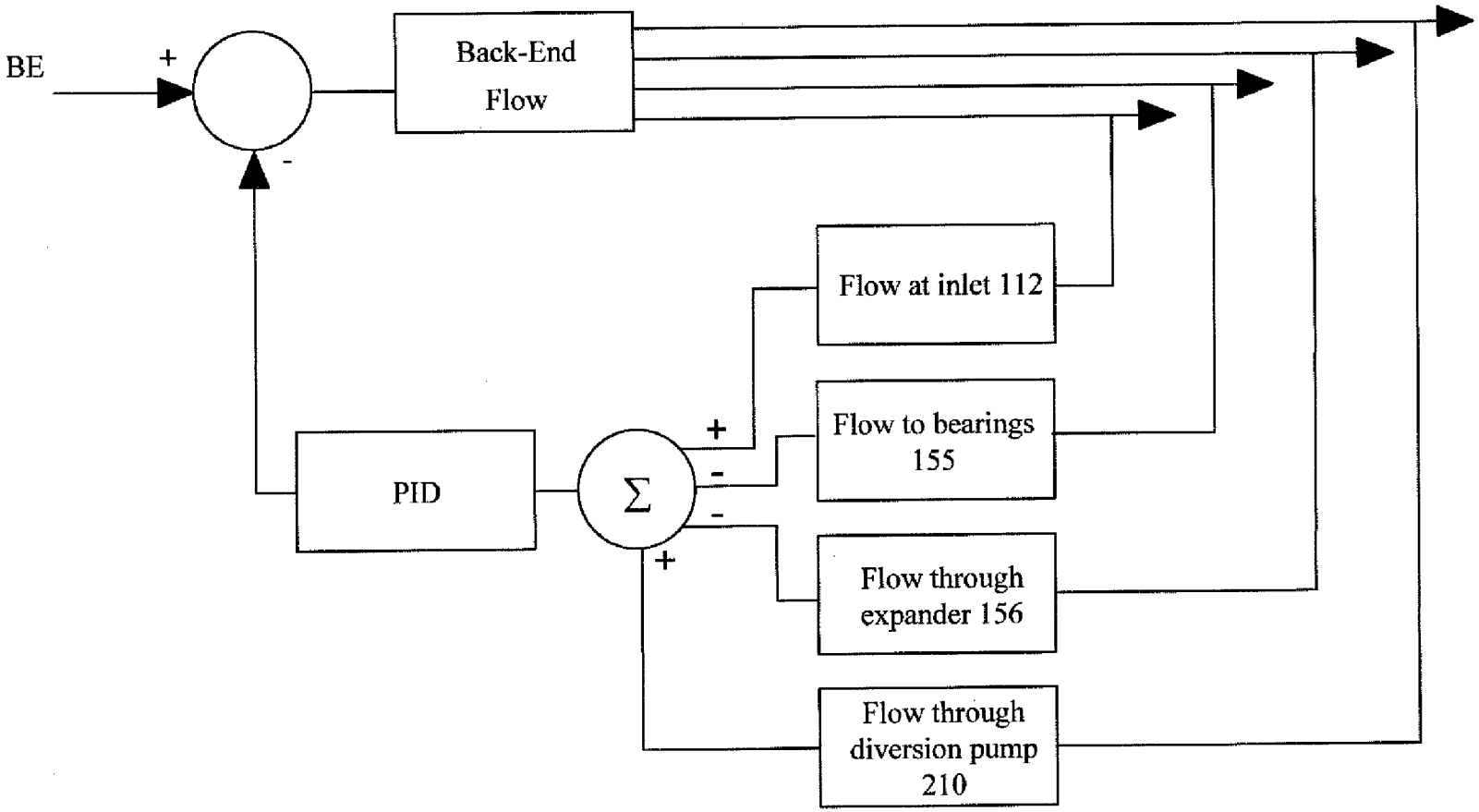
FIGS. 3A-3I are block diagrams showing control loops which may be used in accordance with various embodiments of the present invention.

Referring to FIG. 3A, a block diagram of a closed-loop control scheme is shown as an example for back-end flow control. The two JT valves 174 and 176 discharging the product stream 154" into the separator 180 (FIG. 2) are the controlled elements in this scheme. The controller is configured to hold the larger JT valve 174 (i.e., the valve with the larger $C_v$) in a fixed position such that approximately 80% of the product stream 154" flows therethrough. The smaller JT valve 176 (or the valve with the smaller $C_v$) will dynamically control the remaining approximately 20% of the flow. However, when smaller JT valve 176 is less than approximately 20% open, the larger JT valve 174 may be stepped closed to approximately 60% of its capacity. This will cause the smaller JT valve 176 to become approximately 80% open. When the smaller JT valve 176 becomes approximately 80% open, the larger JT valve 174 may open with the smaller JT valve 176 adjusting accordingly. Additional details regarding multiple valves in this manner are set forth in copending U.S. patent application Ser. No. 11/381,904 filed on May 5, 2006, which has been previously incorporated by reference herein. In using two JT valves 174 and 176 in such a manner, stream fluctuations that occur in short, high-pressure pipe runs are minimized. As noted hereinabove, an accumulator 177 may also be used to help dampen the flow through the two JT valves 174 and 176.

It is noted that, during start up of the liquefaction plant 102 under the presently described control scheme, the controlled element will be JT valve 230 and that control will be switched to JT valves 174 and 176 upon the temperature of the product stream 154" reaching a desired set-point such as, for example, approximately −90° F.

Figure 3B:
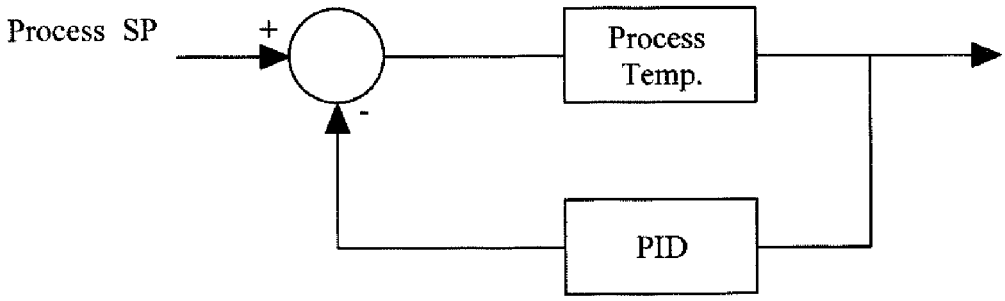

Upon flowing the product stream 154" through JT valves 174 and 176, the cooling loop will fully engage such that liquid is provided by the diversion pump 210 to the heat exchanger 166. As noted hereinabove, temperature of the product stream 154" may be monitored to control the output of the diversion pump 210. This can be controlled, for example, with a PLC using a PID closed loop control scheme, such as shown in FIG. 3B.

The liquid that flows from the diversion pump 210 through the heat exchanger 166 may be directed into any of a number of locations upon its exit from the heat exchanger 166. For example, it may flow to the suction side of the recompression compressor 228 to be compressed to a pressure suitable for either reintroduction into a pipeline 104, receiving station or other structure, or for recirculation within the liquefaction plant 102 as has been discussed hereinabove. Another option may include flowing the gas from the heat exchanger 166 directly into a pipeline 104, receiving station or other structure.

In operating the liquefaction plant 102, certain situations may occur wherein the flow into the compressor 158 becomes insufficient causing the compressor 158 to quickly accelerate because of a lack of load. To prevent this condition, a surge protection line may be routed to flow from the high pressure side of the compressor 158 back to the lower pressure inlet of the compressor 158. This surge protection line may be controlled by a surge protection circuit to prevent the compressor 158 from going into a surge condition when abnormal conditions are present within the liquefaction plant 102.

In one embodiment, the control of such a surge protection line may include closed loop, PID control using the following equation:

EQ 3:

$$SF = 13{,}000\left(\frac{RPM}{85{,}000}\right)\left(\frac{P154}{840}\right)SSF$$

Where SF is surge flow set-point; 13,000 is a constant, and is the minimum flow through the compressor at 85,000 revolutions per minute and 840 psia, (lbm/hr); RPM is the current revolutions per minute of the compressor 158; 85,000 is a constant, and is the design speed (revolutions per minute) of the compressor 158; P154 is the pressure at the inlet of the process stream 154 of the compressor 158 (psia); 840 is the design pressure (psia); and SSF is a surge safety factor for the compressor 158.

Figure 3C:
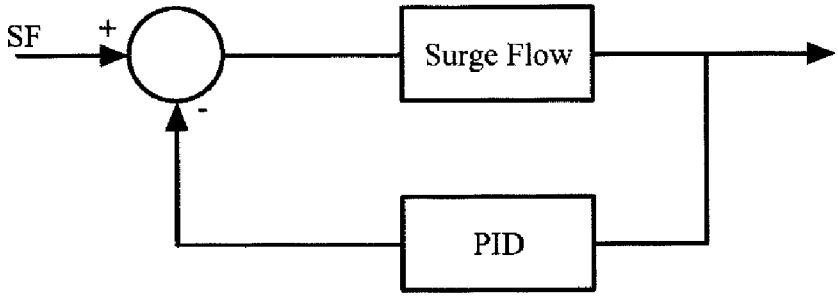

Equation 3 may be used, for example, in conjunction with a closed loop PID control scheme, such as shown in FIG. 3C, wherein a flow meter placed in the process stream 154 may be used as the feedback element, and a control valve in the surge line may be the controlled element.

Since a surge protection line is essentially a safety control loop, the associated control valve is rarely opened. However, if an aberration in the operation of the liquefaction plant 102 causes the flow through the compressor 158 to fall below the surge flow set-point (SF), the control valve will open and cause the flow to circulate back to the inlet of the process stream 154 of the compressor 158. It is noted that use of a flow sensor in the process stream 154 line as the feedback for the surge control prevents the use of such a flow sensor for control of the back-end flow. When the surge loop is activated, the flow through the compressor 158 is accurately reported by the flow sensor. However, in order for the control of back-end flow to adjust for an abnormal or aberrational condition, it will be reading the flow through the compressor 158 indirectly as set forth by EQ 1 set forth hereinabove, which will actually be lower than the reading of a flow sensor in the process stream 154. If control of the back-end flow were to also rely on a flow sensor in the process stream 154, the controller would not be able to correct the abnormal condition, because the flow through the compressor 158 would appear to be correct.

As previously discussed with respect to FIG. 2, methanol 146 may be added to the process to remove water vapor from the feed gas 140 and prevent water from freezing within the various plant components including, for example, within the turbo expander 156. Methanol 146 may be added to the feed gas 140 entering the liquefaction plant 102 through the plant inlet 112 by way of a pump which may include a metering pump. The pump may force the methanol 146 into the flow through a small atomizing nozzle. The amount of methanol 146 injected is equation driven, based on a combination of the flow rate through the plant inlet 112 (such as may be determined by a flow meter 110—FIG. 1) and the water content of the incoming gas.

In one embodiment, the pump may include a multi-piston positive displacement piston pump, wherein each stroke measures out a calibrated quantity. Such a pump may be calibrated by running the pump at a constant speed and measuring the quantity of liquid in a beaker over a given time. An equation may utilize the desired methanol 146 flow value, based on mass flow of the incoming natural gas through the plant inlet 112, and convert the desired flow to motor speed (Hz) based on the calibration of the pump 202. One such equation is as follows:

EQ 4:

$$MF = (A0 + A1(\text{Meth_H}_2\text{O_Content})) * \frac{F112}{10{,}000} * MSF$$

Where: A0=0.79 and is a constant based on methanol/water data; A1=0.626 and is a constant based on methanol/water data; MF is the methanol flow; Meth_$H_2O$_content is the content of $H_2O$ in the gas stream (a constant that must be determined for the particular flow); F112 is the mass flow entering the plant inlet 112; MSF is the methanol safety factor (a constant); and 10,000 is a constant based on the design flow of the liquefaction plant 102.

Figure 3D:
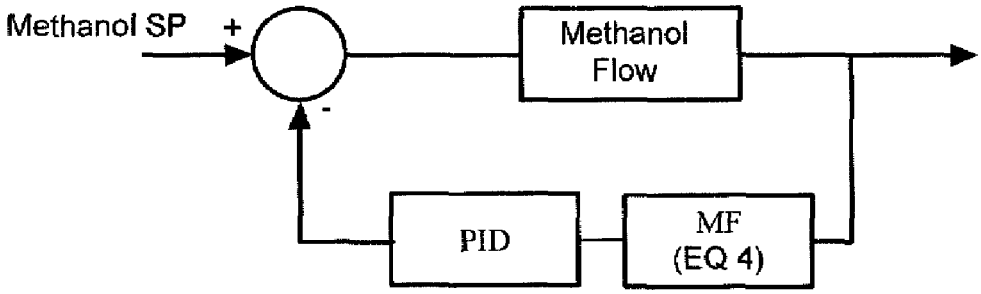

The methanol 146 absorbs the water and both are removed by cyclonic separators, coalescing separators, or both, when the temperature reaches approximately −70° F. in the product stream 154. The cooling stream 152 (and subsequent flow paths) can get to approximately −100° F. before the methanol mixture is removed. The control of the methanol flow may be effected by, for example, an appropriate controlled loop control scheme such as shown in FIG. 3D and using an equation such as Equation 4 set forth above.

Still referring to FIG. 2, liquid level in the separator 180 is desirably maintained between a minimum and maximum level. A differential pressure transducer may be used for sensing the liquid level within the separator 180. The minimum level may be determined so as to provide an adequate resident time for the solid $CO_2$ in the liquid, thereby ensuring a subcooled $CO_2$ particle. The minimum level also ensures that the majority of the expanding flow (i.e., the flow from the JT valves 174 and 176) contacts the fluid surface directly rather than contacting the walls of the separator tank. As previously noted, subcooling all the $CO_2$ in the liquid helps to prevent the particles from sticking to one another and plugging up the system.

Under one operational scheme, the volume difference between maximum and minimum operating levels of the separator 180 may be set to approximately 80% of the volume of a single transfer tank 190A or 190B. However, this volume may be varied if desired. When a level in the separator 180 reaches the maximum level, the slurry is transferred into a first transfer tank (e.g., transfer tank 190A). When the level in the separator 180 reaches a minimum level (or reaches the maximum level of the transfer tank 190A), the transfer of slurry is stopped and the slurry level is allowed to increase in the separator 180.

The transfer tanks 190A and 190B work in conjunction with one another based on the slurry level in the separator 180. The transfer tanks 190A and 190B switch back and forth, both with respect to being filled by the separator 180 and with respect to discharging into a hydrocyclone 192A or 192B. This results in a constant flow of slurry to the hydrocyclones 192A and 192B at a constant pressure. If the transfer of liquid from the transfer tanks 190A and 190B exceeds the production rate in the separator 180, the transfer process may be halted until the slurry level in the separator 180 reaches a desired level (e.g., the maximum level). The transfer process may then resume.

In operation, if one hydrocyclone 192A or 192B becomes plugged, the other will be used while the first is cleaned. If both hydrocyclones 192A, 192B are plugged or otherwise out of service, the separator 180 will be allowed to fill. If the slurry level in the separator 180 reaches a specified level (for example, approximately 90% to 100%) before either of the hydrocyclones 192A, 192B are ready to resume processing, the system will indicate an error and stop of the liquefaction process.

In controlling the hydrocyclones 192A and 192B, two control points may be considered. The first control point is the pressure associated with the flow coming into the hydrocyclones 192A and 192B. The second control point is the differential pressure across the underflow 194A and 194B and the overflow 196A and 196B of each hydrocyclone 192A and 192B. The incoming pressure may be maintained by a motive flow pushing the liquid through the transfer tanks 190A and 190B and into the selected hydrocyclone 192A or 192B. The differential pressure between the underflow 194A and 194B and the overflow 196A and 196B may be controlled by restricting the flow with associated control valves 240A and 240B, respectively.

The underflow 194A and 194B (which contains a $CO_2$ slurry) exits directly into the sublimation tank 214 and may be used as the reference pressure for controlling the differential pressure within the hydrocyclones 192A and 192B. As noted previously, the differential pressure across the hydrocyclones 192A and 192B may be maintained between, for example, −0.5 psid and +1.5 psid. Generally, if the pressure differential is maintained closer to −0.5 psid, more liquid will flow out the overflow 196A and 196B, while generally poorer separation of liquid and solid will be exhibited. As the pressure differential increases to +1.5 psig and higher, more product liquid is pushed out the underflow 194A and 194B with the $CO_2$, but higher separation efficiencies will be exhibited.

Figure 3E:
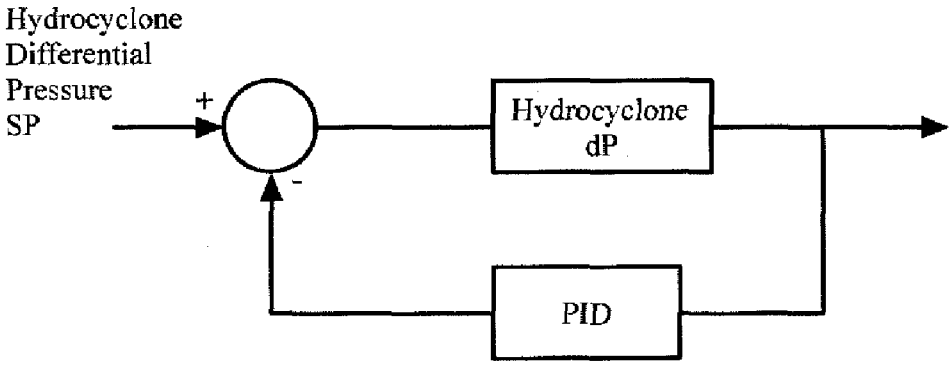

The control valves 240A and 240B, coupled with the respective overflows 196A and 196B of the hydrocyclones 192A and 192B, restrict the flow and may be used to prevent it from dropping below −0.5 psid. The pressure of the storage tank 116 (FIG. 1) may be held at a desired set-point which is equal to, or higher than, the pressure in the separator 180. For example, a pressure differential between the storage tank 116 and hydrocyclone 192A or 192B of about 15 psid may exist. A closed loop control scheme using PID control may be implemented such as is shown in FIG. 3E. The control loop may use one or more differential pressure transmitters as control inputs with the control valves 240A and 240B being the controlled element(s). The hydrocyclone 192A or 192B differential pressure set-point may be manually programmed into the control system, or may be calculated according to various monitored operational parameters, as will be appreciated by those of ordinary skill in the art.

As previously discussed, the filters 200A and 200B may be used to remove any $CO_2$ that may have escaped the separation process effected by the hydrocyclones 192A and 192B. As a filter (e.g., filter 200A) collects $CO_2$, the differential pressure across the filter 200A will increase. When the differential pressure across the filter 200A reaches a specific level (i.e., a defined set-point), the flow of liquid will be switched to the other filter 200B so that the first filter 200A may be allowed to warm and the collected $CO_2$ may be removed therefrom. The warming/cleaning of a given filter 200A or 200B may be user selectable between a passive warming cycle that can take many hours or even days, or an active warming cycle where hot gas is routed through the identified filter until all the filtered or collected $CO_2$ has sublimed back into the liquefaction plant 102. The selection of cleaning methods may be determined by the amount of time that it takes for the filter 200A or 200B to become filled with $CO_2$ during normal operation of the liquefaction plant 102. Isolation of a given filter 200A or 200B for either filtering purposes or for cleaning purposes may be effected through control of three-way valves 204A and 204B or through other appropriate valving and piping, as will be appreciated by those of ordinary skill in the art.

Figure 4:
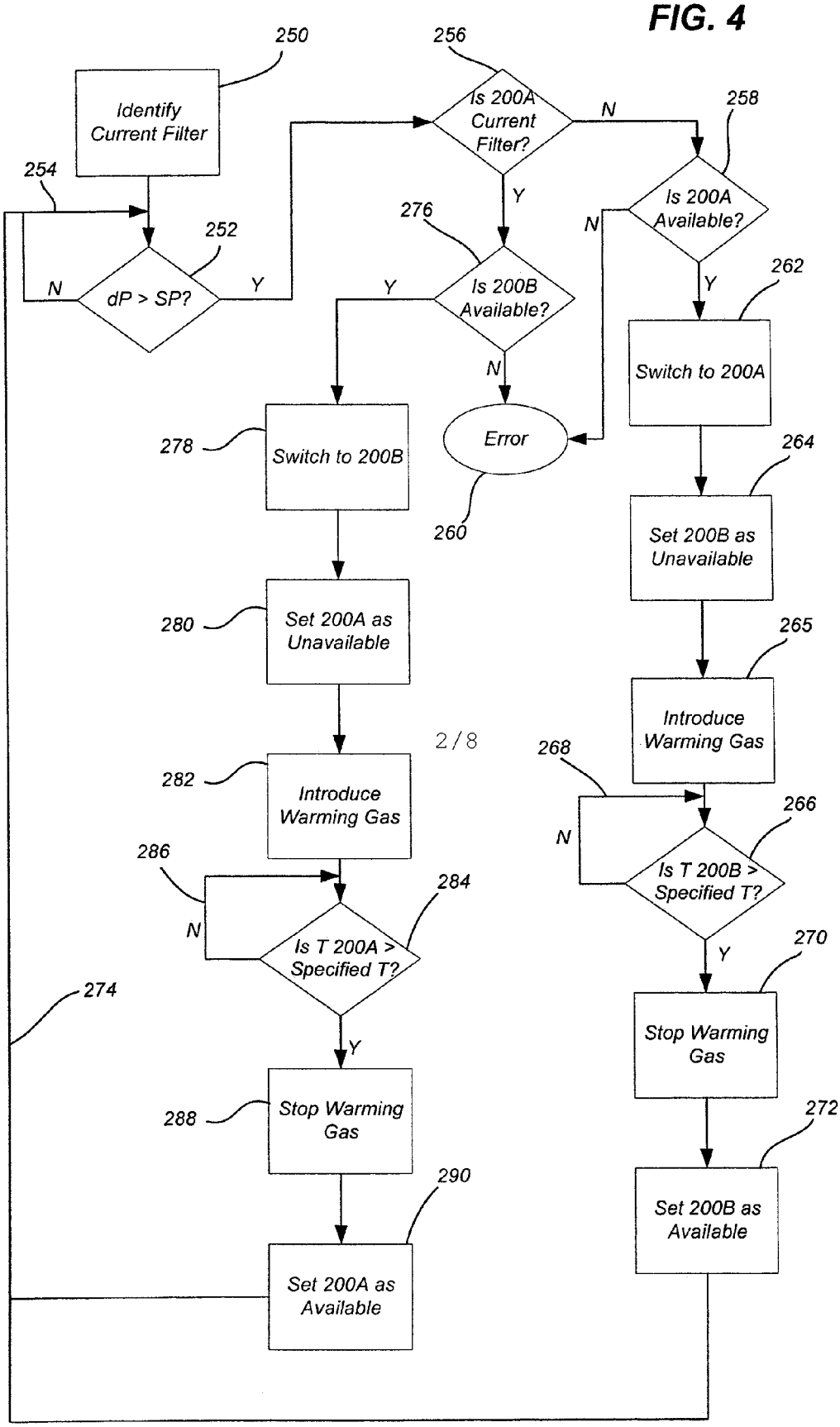
FIG. 4 is a flow diagram relating to a control process that may used with a liquefaction plant in accordance with an embodiment of the present invention.

Referring briefly to FIG. 4 in conjunction with FIG. 2, a flow diagram is shown describing logic that may be used in managing the polishing filters 200A and 200B in accordance with one embodiment of the present invention. As indicated at 250, a filter 200A or 200B is selected for use in filtering liquid passing from the hydrocyclone 192A (or hydrocyclone 192B) to the LNG storage tank 116 (FIG. 1). During filtering, the operational filter is monitored to determine whether the differential pressure (dP) across the filter is greater than a desired set-point (SP) as indicated at 252. If the differential pressure is less than the set-point, the monitoring process continues as indicated by loop 254. If the differential pressure is greater than the set-point, then it is determined whether the first filter 200A is being used as indicated at 256.

If the first filter 200A is not the current filter, it is then determined if the first filter 200A is available (as it is possible that both filters 200A and 200B may be simultaneously unavailable) as indicated at 258. If the first filter 200A is not available, an error message may be reported to the controller as shown at 260. If the first filter 200A is available, then liquid flow is switched to the first filter 200A as indicated at 262 and the second filter 200B is set as being unavailable as indicated at 264.

Warming gas is then introduced into the second filter 200B, such as by supplying such warming gas from interface point 202B, through the filter 200B and out interface connection 136E, as indicated at 265. The temperature of the second filter 200B is monitored and compared with a target temperature as indicated at 266. If the temperature of the filter 200B is less than the target temperature, the process continues, as indicated by loop 268. In one embodiment of the present invention, the target temperature may be approximately −70° F. If the temperature of the filter 200B is greater than the target temperature, indicating that all of the $CO_2$ has been sublimed from the filter 200B, then the flow of warming gas is stopped as indicated at 270. The second filter 200B is then set as being available as indicated at 272 and the process continues as indicated by loop 274.

Returning back to the decision point at 256, if the first filter 200A is the current filter, then it is determined whether the second filter 200B is available as indicated at 276. If the second filter 200B is not available, an error message may be reported as shown at 260. If the second filter 200B is available, then liquid flow is switched to the second filter 200B as indicated at 278 and the first filter 200A is set as being unavailable as indicated at 280.

Warming gas is then introduced into the first filter 200A, such as by supplying such warming gas from interface point 202A, through the filter 200A and out interface connection 136D, as indicated at 282. The temperature of the first filter 200A is monitored and compared with a target temperature as indicated at 284. If the temperature of the filter 200A is less than the target temperature, the process continues, as indicated by loop 286. If the temperature of the filter 200A is greater than the target temperature, indicating that all of the $CO_2$ has been sublimed from the filter 200A, then the flow of warming gas is stopped as indicated at 288. The first filter 200A is then set as being available as indicated at 290 and the process continues as indicated by loop 274.

Figure 3F:
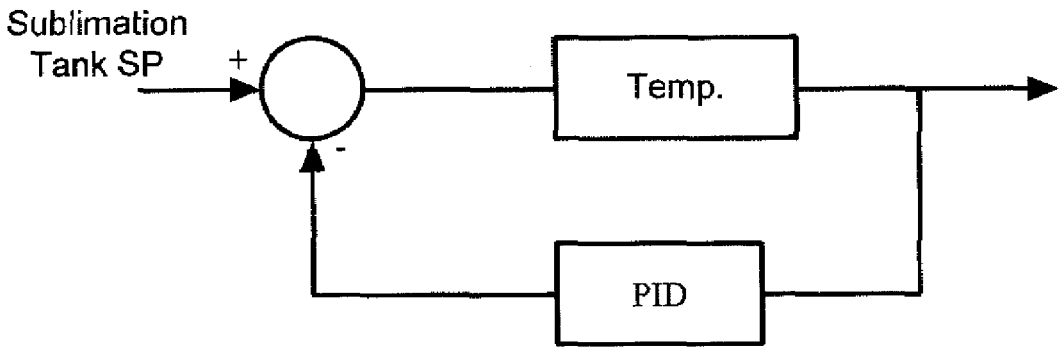

The flow of warm or hot gas flowing from the shell side of the sublimation tank 214 may also be controlled during operation of the liquefaction plant 102. The temperature of the gas exiting the sublimation tank 214 may be monitored and the control valve 244 may be adjusted according to the sensed temperature. In one embodiment, a set-point of approximately −70° F. may be used in operating the valve to control the temperature. A closed loop control scheme using PID control may be implemented such as is shown in FIG. 3F.

Figure 3G:
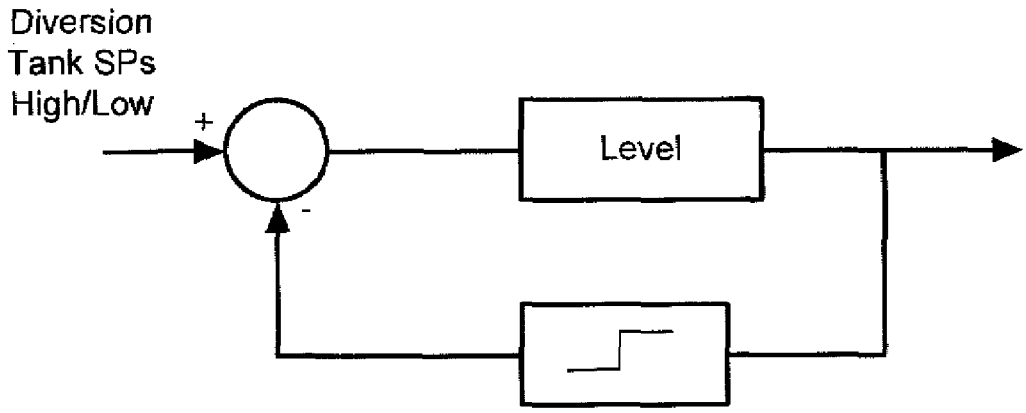

As previously discussed, the diversion tank 206 may be used to divert liquid for cooling purposes. A control loop may be used to control the amount of liquid level of the diversion tank 206. The control scheme may be a simple on/off configuration such that, when the liquid level drops to a specified minimum or low level, make-up pump 212 is started (and associated valves are opened) causing liquid to flow from the storage tank 116 to the diversion tank 206. When the liquid level reaches a maximum or high level in the diversion tank 206, the make-up pump 212 may be shut off (and associated valves closed). A closed loop control scheme using PID control may be implemented such as is shown in FIG. 3G.

Figure 3H:
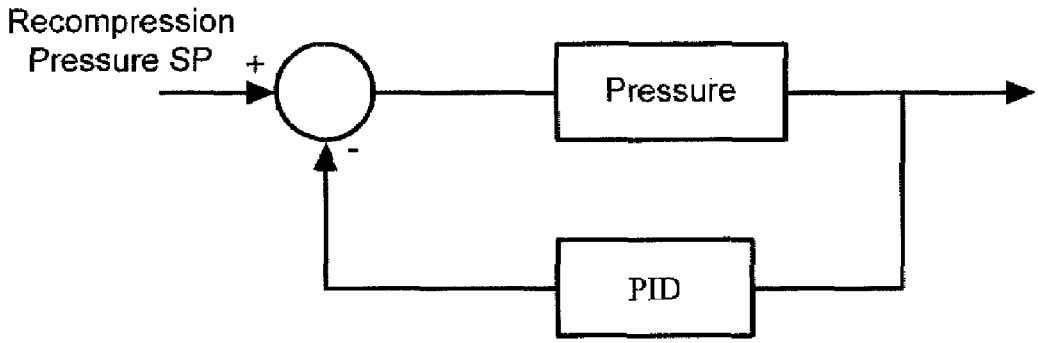

The recompression compressor 228 may also be controlled using, for example, a closed loop PID control scheme such as that which is shown in FIG. 3H. As mass flow decreases within the liquefaction plant 102, the pressure will also drop. A control loop, such as shown in FIG. 3H, may be used to adjust the compressor 230 speed (and thereby prevent surging) and maintain a constant pressure on the suction side of the compressor 230 based on the sensed pressure of, for example, the flow of fluid exiting the liquefaction plant 102 adjacent second plant outlet 132.

Figure 3I:
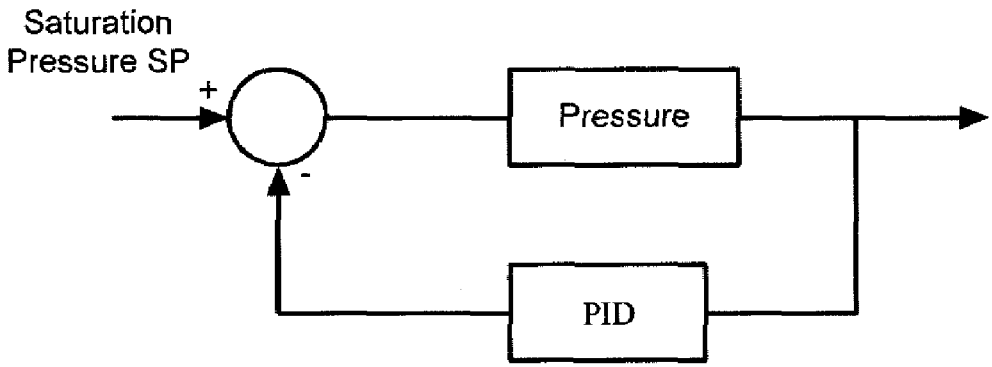

Likewise, the compressor 186 (FIG. 2) may be controlled using, for example, a closed loop PID control scheme such as that which is shown in FIG. 3I. The compressor 186 collects excess vapor flow from the separator 180 and storage tank 116 and boosts the pressure of such gas so that it can be injected into the a stream on the suction side of the recompression compressor 228. To prevent the compressor 186 from surging, a make-up loop 187, may be routed around the compressor 186. A regulator may be disposed in the make-up loop 187 which is set at a desired pressure level. The pressure of the vapor is determined on the suction side of the compressor 186 and the speed of the compressor 186 is adjusted accordingly.

The liquefaction processes depicted and described herein with respect to the various embodiments provide for low cost, efficient and effective means of producing LNG without the requisite "purification" of the gas before subjecting the gas to the liquefaction cycle. Such a process enables the use of relatively "dirty" gas typically found in residential and industrial service lines, eliminates the requirement for expensive pretreatment equipment and provides a significant reduction in operating costs for processing such relatively "dirty" gas.

It is noted that, while the invention has been disclosed primarily in terms of liquefaction of natural gas, the present invention may be utilized simply for removal of gas components, such as, for example, $CO_2$ from a stream of relatively "dirty" gas. Additionally, other gases, such as, for example, hydrogen, may be processed and other gas components, such as, for example, nitrogen, may be removed from a given feed gas. Thus, the present invention is not limited to the liquefaction of natural gas and the removal of $CO_2$ therefrom.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A method of producing liquid natural gas, the method comprising:

providing a source of unpurified natural gas and flowing a portion of the unpurified natural gas from the source;

dividing the portion of unpurified natural gas into at least a process stream and a cooling stream;

flowing the process stream sequentially through a compressor and a first side of at least one heat exchanger;

flowing the cooling stream sequentially through an expander and a second side of the at least one heat exchanger;

sensing a temperature of the process stream after it exits the first side of the at least one heat exchanger;

flowing substantially all of the process stream from the first side of the at least one heat exchanger to the second side of the at least one heat exchanger if a sensed temperature is warmer than a specified temperature; and flowing at least a portion of the process stream from the first side of the at least one heat exchanger to a gas-liquid separator if the sensed temperature is colder than the specified temperature.

2. The method according to claim 1, wherein the specified temperature is between approximately −90° F. and approximately −180° F.

3. The method according to claim 1, wherein flowing substantially all of the process stream from the first side of the at least one heat exchanger to the second side of the at least one heat exchanger further includes flowing at least a portion of the process stream through an expansion valve.

4. The method according to claim 1, wherein flowing at least a portion of the process stream from the first side of the at least one heat exchanger to a gas-liquid separator further includes flowing the at least a portion of the process stream through at least one expansion valve.

5. The method according to claim 4, wherein flowing the at least a portion of the process stream through at least one expansion valve includes flowing the at least a portion of the process stream through at least two expansion valves.

6. The method according to claim 5, further comprising arranging the at least two expansion valves in a parallel flow configuration.

7. The method according to claim 6, further comprising configuring a first expansion valve of the at least two expansion valves to exhibit a first flow capacity ($C_v$) and configuring a second valve of the at least two expansion valves to exhibit a second flow capacity ($C_v$), different from the first flow capacity ($C_v$).

8. The method according to claim 6, further comprising flowing approximately 80% of the at least a portion of the process stream through a first expansion valve of the at least two expansion valves.

9. The method according to claim 8, further comprising flowing a remainder of the at least a portion of the process stream through a second expansion valve of the at least two expansion valves.

10. The method according to claim 1, further comprising producing a slurry of liquid natural gas and solid carbon dioxide from the at least a portion of the process stream within the gas-liquid separator.

11. The method according to claim 10, further comprising agitating the slurry to keep the solid carbon dioxide substantially suspended within the liquid natural gas.

12. The method according to claim 11, wherein agitating the slurry further includes bubbling a gas through the slurry.

13. The method according to claim 10, further comprising transferring at least a portion of the slurry from the gas-liquid separator to at least one transfer tank.

14. The method according to claim 13, wherein transferring at least a portion of the slurry from the gas-liquid separator to at least one transfer tank further comprises selectively transferring the at least a portion of the slurry from the gas-liquid separator to a plurality of transfer tanks.

15. The method according to claim 14, further comprising flowing the at least a portion of the slurry from at least one of the plurality of transfer tanks to at least one hydrocyclone.

16. The method according to claim 15, wherein flowing the at least a portion of the slurry from at least one of the plurality of transfer tanks to at least one hydrocyclone further comprises selectively flowing the at least a portion of slurry from the at least one of the plurality of transfer tanks to a plurality of hydrocyclones.

17. The method according to claim 15, further comprising flowing a slush that is rich in solid carbon dioxide through an underflow of the at least one hydrocyclone to a sublimation tank.

18. The method according to claim 17, further comprising subliming the solid carbon dioxide to a gas.

19. The method according to claim 15, further comprising flowing liquid natural gas through an overflow of the at least one hydrocyclone to a diversion tank.

20. The method according to claim 19, further comprising flowing the liquid natural gas through at least one filter prior to flowing the liquid natural gas to the diversion tank.

21. The method according to claim 19, further comprising flowing at least a portion of the liquid natural gas from the diversion tank to the second side of the at least one heat exchanger.

22. The method according to claim 21, further comprising flowing the at least a portion of the liquid natural gas to a storage tank.

23. The method according to claim 21, further comprising flowing the at least a portion of the cooling stream back into the source of unpurified natural gas.

24. The method according to claim 23, further comprising compressing the at least a portion of the cooling stream prior to flowing it into the source of unpurified natural gas.

25. The method according to claim 21, further comprising recirculating at least a portion of the cooling stream back into at least one of the cooling stream and the process stream.

26. The method according to claim 25, further comprising compressing the at least a portion of the cooling stream prior to recirculating it into at least one of the cooling stream and the process stream.

27. The method according to claim 1, further comprising compressing the portion of the unpurified natural gas flowed from the source prior to dividing the portion of unpurified natural gas into at least a process stream and a cooling stream.

28. A liquefaction plant comprising:

a first flow path defined and configured for sequential delivery of a first stream of natural gas through a compressor and a first side of at least one heat exchanger;

a second flow path defined and configured for sequential delivery of a second stream of natural gas through an expander and a second side of the at least one heat exchanger;

at least two paths including a cooling path and a liquid production path formed from the first flow path at a location subsequent an intended flow of the first stream of natural gas through the first side of the at least one heat exchanger, wherein the cooling path is defined and configured to selectively direct a flow of gas to the second side of the at least one heat exchanger and wherein the liquid production path is defined and configured to selectively direct a flow of gas to a gas-liquid separator.

29. The liquefaction plant of claim 28, further comprising at least one transfer tank located and configured to receive a solid-liquid slurry from the gas-liquid separator.

30. The liquefaction plant of claim 29, wherein the at least one transfer tank includes at least two transfer tanks which are in selective communication with the gas-liquid separator.

31. The liquefaction plant of claim 29, further comprising at least one hydrocyclone in selective communication with the at least one transfer tank.

32. The liquefaction plant of claim 31, further comprising a diversion tank in communication with an overflow of the at least one hydrocyclone.

33. The liquefaction plant of claim 32, further comprising a pump located and configured to convey a mass of liquid from the diversion tank to the second side of the at least one heat exchanger.

34. The liquefaction plant of claim 32, further comprising a storage tank in selective communication with the diversion tank.

35. The liquefaction pant of claim 32, further comprising at least one filter disposed in a flow path between the at least one hydrocyclone and the diversion tank.

36. The liquefaction plant of claim 31, further comprising a sublimation tank in communication with an underflow of the at least one hydrocyclone.

37. The liquefaction plant of claim 28, further comprising a recompression compressor configured to receive a flow of gas from the second side of the at least one heat exchanger.

38. The liquefaction plant of claim 37, further comprising another flow path from the recompression compressor to an exit of the liquefaction plant.

39. The liquefaction plant of claim 37, further comprising another flow path from the recompression compressor to at least one of the first flow path and the second flow path.

40. The liquefaction plant of claim 28, further comprising another compressor in communication with the first flow path and the second flow path.

* * * * *

UNITED STATES PATENT AND TRADEMARK OFFICE

CERTIFICATE OF CORRECTION

PATENT NO. : 7,591,150 B2
APPLICATION NO. : 11/383411
DATED : September 22, 2009
INVENTOR(S) : Terry D. Turner, Bruce M. Wilding and Michael G. McKellar It is certified that error appears in the above-identified patent and that said Letters Patent is hereby corrected as shown below:

On the title page:
In ITEM (56) References Cited

| | |
|---|---|
| Page 2, 1st column, 15th entry, | change "6/1967 Carr" to --7/1967 Carr-- |
| Page 2, 1st column, 16th entry, | change "10/1967 Crownover" to --1/1968 Crownover-- |
| Page 2, 1st column, 46th entry, | change "3/1982 Holmes" to --9/1982 Holmes-- |
| Page 2, 1st column, 48th entry, | change "11/1982 Strass" to --9/1982 Strass-- |

In the specification:

| | | |
|---|---|---|
| COLUMN 1, | LINE 15, | change "priority of U.S." to --priority to U.S.-- |
| COLUMN 4, | LINE 57, | change "FIGS. 3A-3I" to --FIGS. 3A through 3I-- |
| COLUMN 4, | LINE 61, | change "may used" to --may be used-- |
| COLUMN 5, | LINE 45, | change "different flow circuits." to --different flow circuit.-- |
| COLUMN 7, | LINE 48, | change "America LEWA" to --America LEWA, Inc.,-- |
| COLUMN 7, | LINE 56, | change "methanol or" to --methanol **146** or-- |
| COLUMN 10, | LINE 3, | change "Inc. of" to --Inc., of-- |
| COLUMN 14, | LINE 2, | change "**224A** and" to --**224** and-- |
| COLUMN 15, | LINE 55, | change "recompressor **228**" to --compressor **228**-- |
| COLUMN 16, | LINE 4, | change "used provide" to --used to provide-- |

Signed and Sealed this

Sixteenth Day of November, 2010

David J. Kappos

David J. Kappos
*Director of the United States Patent and Trademark Office*